US007030850B2

(12) United States Patent
Morita

(10) Patent No.: US 7,030,850 B2
(45) Date of Patent: Apr. 18, 2006

(54) SIGNAL DRIVE CIRCUIT, DISPLAY DEVICE, ELECTRO-OPTICAL DEVICE, AND SIGNAL DRIVE METHOD

(75) Inventor: Akira Morita, Suwa (JP)

(73) Assignee: Seiko Epson Corporation, (JP)

( * ) Notice: Subject to any disclaimer, the term of this patent is extended or adjusted under 35 U.S.C. 154(b) by 0 days.

(21) Appl. No.: 11/053,097

(22) Filed: Feb. 8, 2005

(65) Prior Publication Data

US 2005/0156850 A1 Jul. 21, 2005

Related U.S. Application Data

(62) Division of application No. 10/154,436, filed on May 23, 2002.

(30) Foreign Application Priority Data

May 24, 2001 (JP) ..... 2001-155194

(51) Int. Cl.
*G09G 3/36* (2006.01)

(52) U.S. Cl. ..... 345/98; 345/89; 345/99; 345/100; 315/169.2

(58) Field of Classification Search ..... 345/208, 345/209, 89, 95, 99, 100; 315/169.1, 169.2, 315/169.3; 257/59
See application file for complete search history.

(56) References Cited

U.S. PATENT DOCUMENTS 6,130,657 A 10/2000 Kurokawa et al.
6,137,537 A * 10/2000 Tsuji et al. ..... 348/554
6,262,704 B1 7/2001 Kurumisawa et al.
6,380,917 B1 4/2002 Matsueda et al. ..... 345/89
6,384,806 B1 * 5/2002 Matsueda et al. ..... 345/89
6,674,422 B1 1/2004 Ozawa ..... 345/98
6,707,437 B1 * 3/2004 Kuno et al. ..... 345/74.1
6,727,875 B1 * 4/2004 Mikami et al. ..... 345/92
6,731,266 B1 5/2004 Jung ..... 345/103

(Continued)

FOREIGN PATENT DOCUMENTS

CN 1246698 A 3/2000

(Continued)

OTHER PUBLICATIONS

Communication from Japanese Patent Office regarding related application.

*Primary Examiner*—Amr A. Awad
*Assistant Examiner*—Abbas Abdulselam
(74) *Attorney, Agent, or Firm*—Harness, Dickey & Pierce, P.L.C.

(57) ABSTRACT

A signal drive circuit capable of flexibly dealing with the change of the panel size and reducing power consumption, a display device and an electro-optical device using that signal drive circuit, and a signal drive method. A signal driver (signal drive circuit) includes: a shift register which sequentially shifts image data corresponding to signal lines in units of blocks each of which including a plurality of signal lines; a line latch which latches the image data in synchronization with a horizontal synchronization signal LP; a drive voltage generation circuit which generates a drive voltage based on the image data; and a signal line drive circuit, wherein high impedance control is performed for output to the signal lines, based on block output select data BLK designated in units of blocks; and wherein partial display control is performed based on the partial display data PART. Display control for the block output select data BLK in units of blocks is given priority in comparison with the partial display data PART.

7 Claims, 28 Drawing Sheets

U.S. PATENT DOCUMENTS

| | | | | |
|---|---|---|---|---|
| 2001/0033278 | A1* | 10/2001 | Ohta et al. | 345/204 |
| 2001/0035862 | A1 | 11/2001 | Nakamura et al. | 345/204 |
| 2002/0190971 | A1 | 12/2002 | Nakamura et al. | 345/204 |

FOREIGN PATENT DOCUMENTS

| | | |
|---|---|---|
| JP | 05-072992 | 3/1993 |
| JP | 08-286170 | 11/1996 |
| JP | 09-055909 | 2/1997 |
| JP | 10-161595 | 6/1998 |
| JP | 10-282939 | 10/1998 |
| JP | 11-183880 | 7/1999 |
| JP | 2001-125071 | 5/2001 |
| JP | 2002-162946 | 6/2002 |
| WO | WO97/22036 | 6/1997 |

* cited by examiner

LARGE LCD PANEL

SMALL LCD PANEL

BLOCK OUTPUT SELECT DATA:
Hi-Z CONTROL ON

BLOCK OUTPUT SELECT DATA:
Hi-Z CONTROL OFF
PARTIAL DISPLAY DATA: ON

BLOCK OUTPUT SELECT DATA:
Hi-Z CONTROL OFF
PARTIAL DISPLAY DATA: OFF

FIG. 15A SHL = "H"
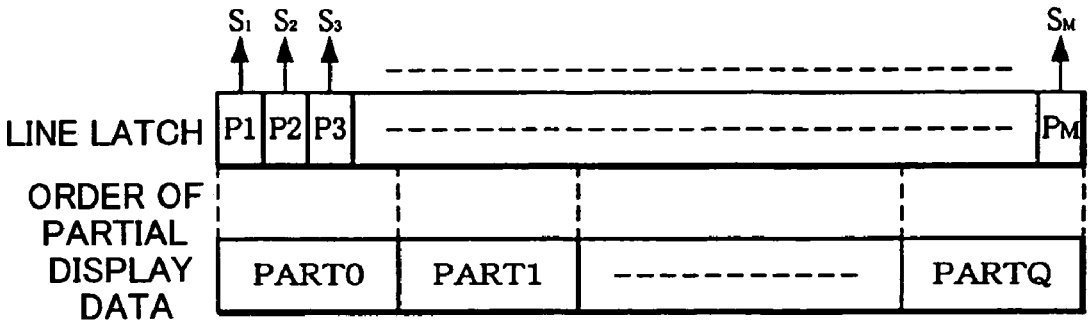
FIG. 15B SHL = "L"
ORDER OF DATA IS NOT CHANGED
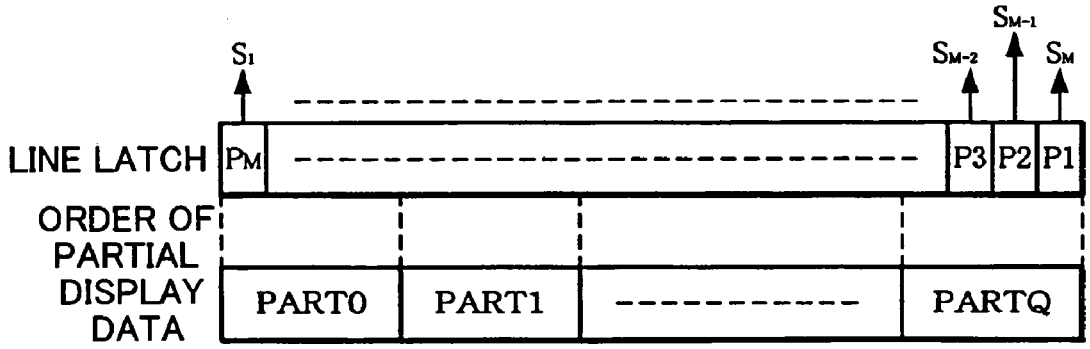
FIG. 15C SHL = "L"
ORDER OF DATA IS CHANGED
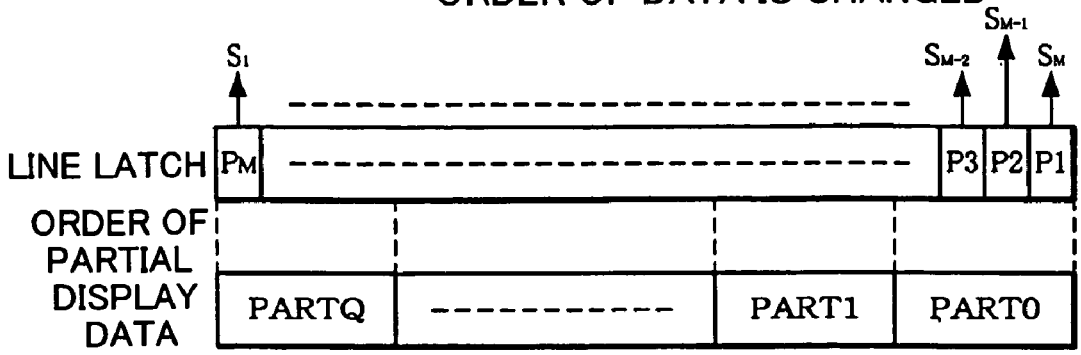

SIGNAL DRIVER (BLOCK UNIT)

REFERENCE VOLTAGE SELECT SIGNAL GENERATION

NON-DISPLAY-LEVEL VOLTAGE SUPPLY

FIG. 27

| BLOCK OUTPUT SELECT REGISTER | PARTIAL DISPLAY SELECT REGISTER | DATA BYPASS | DAC | OPERATIONAL AMPLIFIER | PARTIAL-NON-DISPLAY LEVEL OUTPUT |
|---|---|---|---|---|---|
| BLOCK OUTPUT SELECT (BLK=1) | PARTIAL DISPLAY SELECT (PART=1) | disable | enable | enable | disable |
| | PARTIAL DISPLAY NON-SELECT (PART=0) | disable | disable | disable | enable |
| BLOCK OUTPUT NON-SELECT (BLK=0) | PARTIAL DISPLAY SELECT (PART=1) | enable | disable | disable | disable |
| | PARTIAL DISPLAY NON-SELECT (PART=0) | enable | disable | disable | disable |

SIGNAL DRIVE CIRCUIT, DISPLAY DEVICE, ELECTRO-OPTICAL DEVICE, AND SIGNAL DRIVE METHOD

CROSS-REFERENCE TO RELATED APPLICATIONS

This is a divisional patent application of U.S. Ser. No. 10/154,436 filed May 23, 2002 which claims priority to Japanese Patent Application No. 2001-155194 filed on May 24, 2001, both of which are hereby incorporated by reference.

TECHNICAL FIELD

The present invention relates to a signal drive circuit, a display device and electro-optical device using the signal drive circuit, and a signal drive method.

BACKGROUND

In recent years, use of portable telephones and other types of electronic equipment has become widespread. Accompanied by this, liquid crystal panels having various sizes have been used. As such liquid crystal panels, a simple matrix type liquid crystal panel using an STN (Super Twisted Nematic) liquid crystal and an active matrix type liquid crystal panel using a thin film transistor (hereinafter abbreviated as "TFT") liquid crystal are known. The simple matrix type liquid crystal panel using an STN liquid crystal prevents a decrease in contrast by preventing a decrease in frame response by devising the drive method, whereby the power consumption can be reduced. The active matrix type liquid crystal panel using a TFT liquid crystal is more suitable for video display due to high contrast by the high-speed frame response.

SUMMARY

According to one aspect of the present invention, there is provided a signal drive circuit which drives signal lines of an electro-optical device having pixels specified by a plurality of scan lines and a plurality of signal lines which intersect each other, based on image data, the signal drive circuit comprising:

a line latch which latches the image data in a horizontal scanning cycle;

a drive voltage generation circuit which generates a drive voltage for each signal line based on the image data latched in the line latch; and a signal line drive circuit which drives each signal line based on the drive voltage generated by the drive voltage generation circuit, wherein high impedance control is performed for an output of the signal line drive circuit in units of blocks, each block including a given plural number of the signal lines.

According to another aspect of the present invention, there is provided a signal drive method of driving a signal drive circuit which drives signal lines of an electro-optical device having pixels specified by a plurality of scan lines and a plurality of signal lines which intersect each other, based on image data, and includes:

a line latch which latches the image data in a horizontal scanning cycle;

a drive voltage generation circuit which generates a drive voltage for each signal line based on the image data latched in the line latch; and a signal line drive circuit which drives each signal line based on the drive voltage generated by the drive voltage generation circuit, wherein high impedance control is performed on the signal line drive circuit in units of blocks, based on control instruction data set in units of blocks, each block including a given plural number of the signal lines.

BRIEF DESCRIPTION OF THE SEVERAL VIEWS OF THE DRAWING

FIGS. 15A, 15B, and 15C schematically show the relationship between image data in the line latch and the blocks.

FIG. 27 is illustrative of the contents controlled by the signal driver according to one embodiment of the present invention.

DETAILED DESCRIPTION

Figure 1:
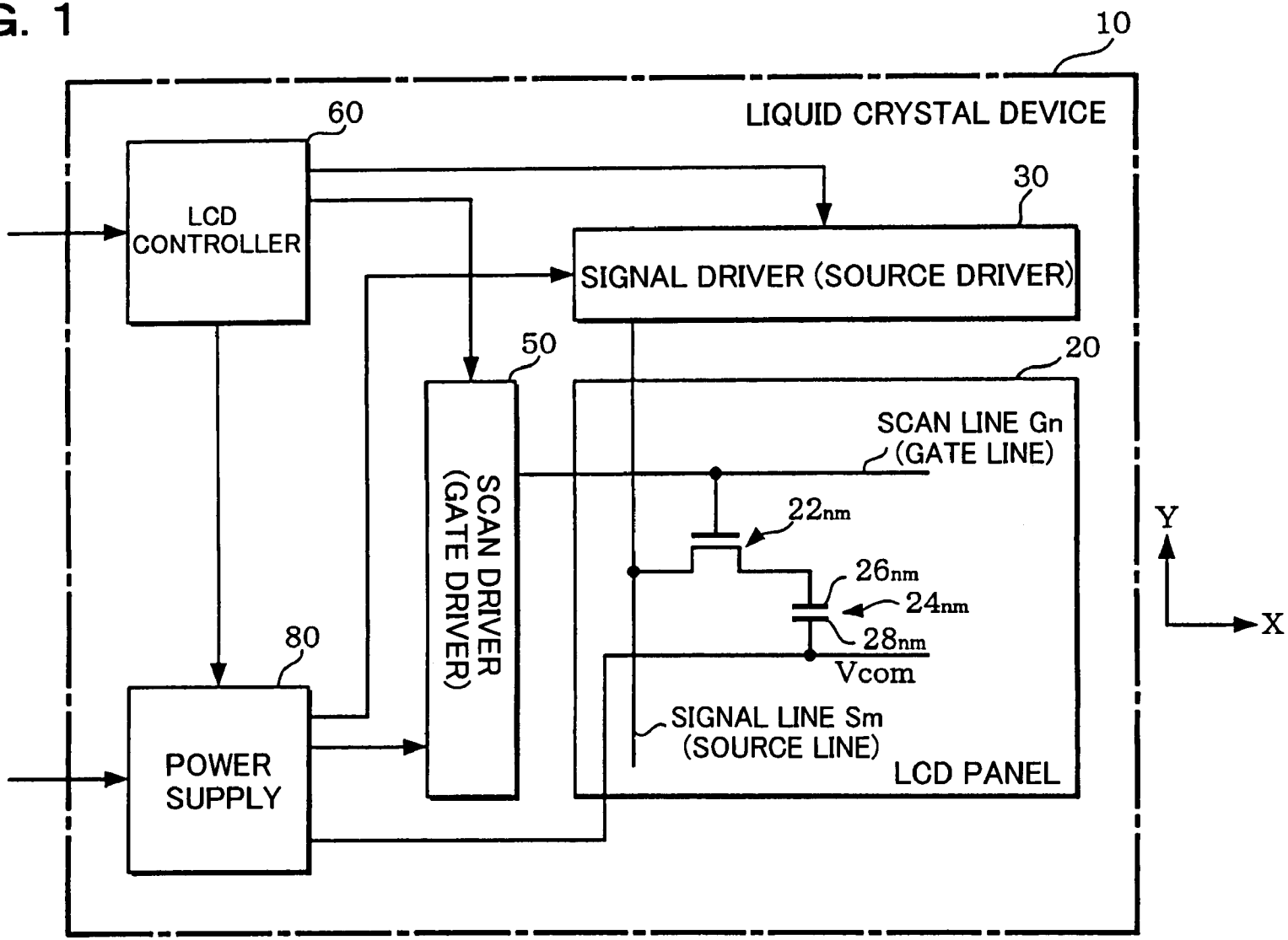
FIG. 1 is a block diagram schematically showing a display device to which is applied a signal drive circuit (signal driver) according to one embodiment of the present invention.

Embodiments of the present invention will be described below.

Note that the embodiments described below do not in any way limit the scope of the invention defined by the claims laid out herein. Similarly, all the elements of the embodiments described below should not be taken as essential requirements of the present invention.

Generally, a drive circuit having signal line drive circuits for lines determined by at least the size of the liquid crystal panel is mounted in electronic equipment in which a liquid crystal panel is installed to optimize a decrease in the size and weight.

However, the manufacturing cost of an active matrix type liquid crystal panel using a TFT liquid crystal is increased in comparison with a simple matrix type liquid crystal panel using an STN liquid crystal due to the complexity of the manufacturing steps and the like. Moreover, if the design of the drive circuit is changed because of the size of the liquid crystal panel, the cost of the products is more and more increased due to an increase in the development steps, and placement of products on the market is delayed. Furthermore, since the active matrix type liquid crystal panel using a TFT liquid crystal consumes a large amount of electric power, it is necessary to decrease the power consumption.

The following embodiments have been achieved in view of the above technical subjects. According to the following embodiments, a signal drive circuit capable of flexibly dealing with the change of panel size and decreasing the power consumption by controlling signal line drive circuits for the number of lines corresponding to the panel size, a display device and an electro-optical device using the same, and a signal drive method can be provided.

One embodiment of the present invention provides a signal drive circuit which drives signal lines of an electro-optical device having pixels specified by a plurality of scan lines and a plurality of signal lines which intersect each other, based on image data, the signal drive circuit comprising:

a line latch which latches the image data in a horizontal scanning cycle;

a drive voltage generation circuit which generates a drive voltage for each signal line based on the image data latched in the line latch; and a signal line drive circuit which drives each signal line based on the drive voltage generated by the drive voltage generation circuit, wherein high impedance control is performed for an output of the signal line drive circuit in units of blocks, each block including a given plural number of the signal lines.

The electro-optical device may comprise a plurality of scan lines and a plurality of signal lines which intersect each other, switching circuits connected to the scan lines and the signal lines, and pixel electrodes connected to the switching circuits, for example.

The signal lines divided in blocks may be a plurality of signal lines adjacent to each other, or a plurality of optionally selected signal lines.

In this configuration, since high impedance control is performed for the outputs of the signal line drive circuit in units of blocks each of which includes a plurality of signal lines, by the signal drive circuit which drives the signal lines of the electro-optical device based on the image data, a signal drive circuit which can be flexibly applied to various types of panel sizes can be provided. Therefore, a change of design of the signal drive circuit or the like accompanied by the change of the panel size is unnecessary, and cost reduction and speedy placement on the market can be achieved.

In this signal drive circuit, operation termination of the drive voltage generation circuit may be controlled in units of blocks.

Since the operation termination of the drive voltage generation circuit corresponding to the signal lines which need not be driven depending on the panel size can be enabled, power consumption can be reduced effectively while achieving the above effects.

This signal drive circuit may further comprise:

a shift register which temporarily holds image data necessary for one horizontal scan to be latched by the line latch, and includes flip-flops connected to each other and corresponding to the signal lines; and a data transfer circuit provided in each block to receive and transfer image data to flip-flops in an adjacent block when high impedance control is performed on a block in which the data transfer circuit is provided.

Even if a block in which high impedance control is performed for output is changed depending on the mounting conditions, the image data can be supplied to the corresponding signal lines by bypassing such a block. This eliminates the need for the supplier of the image data to change the image data according to the setting of the block in which high impedance control is performed for outputs, whereby convenience for the user can be improved.

This signal drive circuit may further comprise a control instruction data holding circuit which holds control instruction data in units of blocks, wherein the control instruction data is used to perform high impedance control for an output of the signal line drive circuit, or to control operation termination of the drive voltage generation circuit, in units of blocks.

In this configuration, the signal drive circuit includes the control instruction data holding circuit, and control of the output of the signal line drive circuit or control of the operation termination of the drive voltage generation circuit is performed in units of blocks, based on the control instruction data. Therefore, it is possible to easily deal with the change of type of panel size, whereby the cost can be reduced.

In this signal drive circuit, an output of the drive voltage for the signal lines may be controlled in units of blocks, in one or more blocks in which no high impedance control is performed for the output of the signal line drive circuit.

In this configuration, an output of the drive voltage for the signal lines is controlled in units of blocks, in one or more blocks in which no high impedance control is performed for the output of the signal line drive circuit. This enables a partial display control by setting a display area and a non-display area, whereby the power consumption can be further reduced.

The signal drive circuit may further comprise a partial display data holding circuit which holds partial display data indicating permission for or prohibition against output to the signal lines on the basis of image data in units of blocks, wherein an output of the drive voltage for the signal lines is controlled in units of blocks based on the partial display data by the signal line drive circuit in one or more blocks in which no high impedance control is performed for an output of the signal line drive circuit.

In this configuration, the signal drive circuit which drives the signal lines of the electro-optical device based on the image data includes a partial display data holding circuit which holds partial display data indicating permission for or prohibition against output to the signal lines on the basis of image data in units of blocks each of which includes the plurality of signal lines. An output of the image data for one horizontal scan is controlled in units of blocks, based on the partial display data designated in units of blocks. Therefore, partial display control enabling optional setting can be performed. This reduces power consumption due to signal driving in the non-display area.

In the signal drive circuit, the signal line drive circuit may include: an impedance conversion circuit which performs impedance conversion for the drive voltage generated by the drive voltage generation circuit to output the converted drive voltage to each of the signal lines; and a non-display-level voltage supply circuit which supplies a non-display-level voltage to the signal lines, wherein one of the impedance conversion circuit and the non-display-level voltage supply circuit drives the signal lines included in one or more blocks in which no high impedance control is performed for the outputs of the signal line drive circuit, in units of blocks, based on the partial display data.

In this configuration, the signal lines are driven based on the image data by either the impedance conversion circuit or the non-display-level voltage is supplied to the signal lines by the non-display-level voltage supply circuit in units of blocks based on the content of the partial display data. Therefore, the non-display area can be set to a given normally color. This enables the display area set by the partial display control to be conspicuous while achieving the above effects.

In the signal drive circuit, the impedance conversion circuit may perform impedance conversion for the drive voltage and output the converted drive voltage to the signal lines in a block in which output is permitted by the partial display data, and may put the signal lines in a block in which output is prohibited by the partial display data, into a high impedance state; and the non-display-level voltage supply circuit may put the signal lines in a block in which output is permitted by the partial display data, into a high impedance state, and may supply a non-display-level voltage to the signal lines in a block in which output is prohibited by the partial display data.

In this configuration, the impedance conversion circuit and the non-display-level voltage supply circuit in the block set to the non-display area can be controlled in units of blocks based on the partial display data, whereby power consumption in the block set to the non-display area can be effectively reduced.

In the signal drive circuit, the drive voltage generation circuit may terminate generation operation of the drive voltage for the signal lines in a block in which output is prohibited by the partial display data.

The drive voltage generation circuit in the block set to the non-display area can be controlled in units of blocks based on the partial display data, whereby power consumption in the block set to the non-display area can be effectively reduced.

In the signal drive circuit, the electro-optical device may include pixel electrodes provided corresponding to the pixels through switching circuits connected to the scan lines and the signal lines; and the non-display-level voltage may cause a difference between a voltage applied to each of the pixel electrodes and a voltage applied to each of common electrodes provided opposite to the pixel electrodes with electro-optical elements interposed, to be smaller than a given threshold value.

In this configuration, the non-display-level voltage is a voltage which causes a difference between a voltage applied to the pixel electrodes and a voltage applied to the common electrodes disposed opposite to the pixel electrodes with electro-optical elements interposed, to be smaller than a given threshold value. Therefore, the non-display area can be set within the range in which at least the transmittance ratio of the pixels of the electro-optical device is not changed, whereby the partial display control can be simplified irrespective of precision of partial-non-display-level voltage.

In the signal drive circuit, the electro-optical device may include pixel electrodes provided corresponding to the pixels through switching circuits connected to the scan lines and the signal lines; and the non-display-level voltage may be substantially equal to a voltage of common electrodes provided opposite to the pixel electrodes with electro-optical elements interposed.

In this configuration, the non-display-level voltage is set so that the difference in voltage between the pixel electrodes and the common electrodes opposite thereto is substantially 0, the partial display control can be simplified, and image display which allows the display area to be conspicuous can be achieved by making the color of the non-display area uniform.

In the signal drive circuit, the non-display-level voltage may be the maximum value or the minimum value of a gray scale voltage generated on the basis of image data.

Since one of the voltages at the opposite edges of the gray scale voltage generated by the drive voltage generation circuit is supplied as the non-display-level voltage, the user can optionally designate a normally color for the non-display area, whereby convenience for the user can be improved.

In the signal drive circuit, each of the blocks may correspond to 8 pixels.

Since the display area and the non-display area can be set in units of characters, partial display control can be simplified and an image by effective partial display can be provided.

According to one embodiment of the present invention, there is provided a display device comprising:

an electro-optical device having pixels specified by a plurality of scan lines and a plurality of signal lines which intersect each other;

a scanning drive circuit which drives the scan lines; and the signal drive circuit as defined in claim 1 which drives the signal lines based on image data.

In this configuration, even if the panel size is changed, a display device capable of implementing appropriate signal line driving and reducing power consumption at low cost can be placed on the market as soon as possible.

In this display device, a block in which high impedance control is performed for an output of the signal line drive circuit in the signal drive circuit may be changed depending on the relationship between disposition of the signal lines in the electro-optical device and disposition of the signal line drive circuit in the signal drive circuit.

Since the signal drive circuit necessary for driving the signal lines of the electro-optical device can be disposed at an optimum position corresponding to the size of the electro-optical device, flexibility of the mounting area can be improved.

In this display device, high impedance control may be performed for an output of the signal line drive circuit disposed near a center part of the signal drive circuit excluding right and left portions.

In this configuration, interconnect distance between the electro-optical device and the signal drive circuit can be decreased and the interval therebetween can be reduced, whereby the mounting area can be decreased.

According to one embodiment of the present invention, there is provided an electro-optical device comprising:

pixels specified by a plurality of scan lines and a plurality of signal lines which intersect each other;

a scanning drive circuit which drives the scan lines; and the signal drive circuit as defined in claim 1 which drives the signal lines based on image data.

In this configuration, even if the panel size is changed, an electro-optical device capable of implementing appropriate signal line driving and reducing in power consumption at low cost can be placed on the market as soon as possible.

In this electro-optical device, a block in which high impedance control is performed for an output of the signal line drive circuit in the signal drive circuit may be changed depending on the relationship between disposition of the signal lines and disposition of the signal line drive circuit in the signal drive circuit.

In this configuration, since the signal drive circuit necessary for driving the signal lines of the electro-optical device can be disposed at an optimum position corresponding to the arrangement of the signal lines which specify the pixels, flexibility of the mounting area can be improved.

According to one embodiment of the present invention, there is provided a signal drive method of driving a signal drive circuit which drives signal lines of an electro-optical device having pixels specified by a plurality of scan lines and a plurality of signal lines which intersect each other, based on image data, and includes:

a line latch which latches the image data in a horizontal scanning cycle;

a drive voltage generation circuit which generates a drive voltage for each signal line based on the image data latched in the line latch; and a signal line drive circuit which drives each signal line based on the drive voltage generated by the drive voltage generation circuit, wherein high impedance control is performed on the signal line drive circuit in units of blocks, based on control instruction data set in units of blocks, each block including a given plural number of the signal lines.

In this configuration, since high impedance control can be performed for the outputs to the signal lines in units of blocks, it is possible to flexibly deal with the change of the panel size and reduce power consumption.

These embodiments of the present invention will be described below in detail with reference to the drawings.

1. Display Device 1.1 Configuration

FIG. 1 shows a display device to which a signal drive circuit (signal driver) of one embodiment of the present invention is applied.

A liquid crystal device 10 as the display device includes a liquid crystal display (hereinafter abbreviated as "LCD") panel 20, a signal driver (signal drive circuit) (source driver in a narrow sense) 30, a scanning driver (scanning drive circuit) (gate driver in a narrow sense) 50, an LCD controller 60, and a power supply circuit 80.

The LCD panel (electro-optical device in a broad sense) 20 is formed on a glass substrate, for example. A plurality of scan lines (gate lines in a narrow sense) G1 to GN (N is a natural number of two or more) which are arranged in the Y direction and extend in the X direction, and a plurality of signal lines (source lines in a narrow sense) S1 to SM (M is a natural number of two or more) which are arranged in the X direction and extend in the Y direction are disposed on the glass substrate. A TFT 22*nm* (switching circuit in a broad sense) is formed corresponding to the intersection between the scan line Gn (1□n □N, n is a natural number) and the signal line Sm (1□m □M, m is a natural number).

A gate electrode of the TFT 22*nm* is connected to the scan line Gn. A source electrode of the TFT 22*nm* is connected to the signal line Sm. A drain electrode of the TFT 22*nm* is connected to a pixel electrode 26*nm* of a liquid crystal capacitance (liquid crystal element in a broad sense) 24*nm*.

The liquid crystal capacitance 24*nm* is formed by sealing a liquid crystal between the pixel electrode 26*nm* and a common electrode 28*nm* opposite thereto. The transmittance of the pixel is changed corresponding to the voltage applied between the electrodes.

A common electrode voltage Vcom generated by the power supply circuit 80 is supplied to the common electrode 28*nm*.

The signal driver 30 drives the signal lines S1 to SM of the LCD panel 20 based on image data for one horizontal scan.

The scanning driver 50 sequentially drives the scan lines G1 to GN of the LCD panel 20 in one vertical scanning period in synchronization with a horizontal synchronization signal.

The LCD controller 60 controls the signal driver 30, scanning driver 50, and power supply circuit 80 according to the content set by a host such as a central processing unit (hereinafter abbreviated as "CPU") (not shown). More specifically, the LCD controller 60 supplies the setting of the operation mode or a vertical synchronization signal or horizontal synchronization signal generated therein to the signal driver 30 and the scanning driver 50, for example. The LCD controller 60 supplies polarization inversion timing of the common electrode voltage Vcom to the power supply circuit 80.

The power supply circuit 80 generates a voltage level necessary for driving the liquid crystal of the LCD panel 20 or the common electrode voltage Vcom based on a reference voltage supplied from the outside. These voltage levels are supplied to the signal driver 30, scanning driver 50, and LCD panel 20. The common electrode voltage Vcom is supplied to the common electrode provided opposite to the pixel electrode of the TFT of the LCD panel 20.

In the liquid crystal device 10 having the above configuration, the LCD panel 20 is driven by the signal driver 30, scanning driver 50, and power supply circuit 80 under the control of the LCD controller 60 based on the image data supplied from the outside.

In FIG. 1, the liquid crystal device 10 includes the LCD controller 60. However, the LCD controller 60 may be provided outside the liquid crystal device 10. The liquid crystal device 10 may include the host together with the LCD controller 60.

(Signal Driver)

Figure 2:
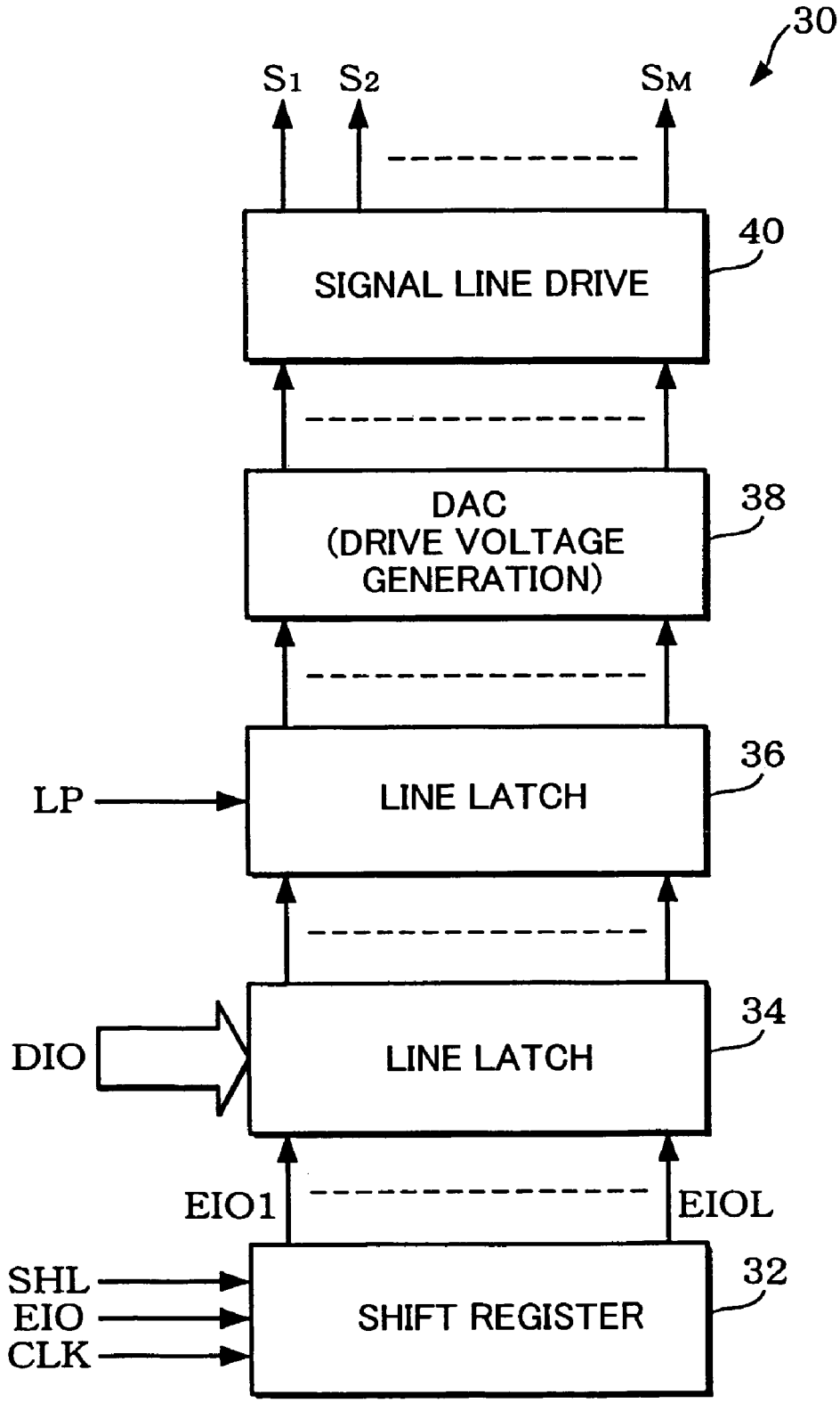
FIG. 2 is a block diagram schematically showing a signal driver shown in FIG. 1.

FIG. 2 shows an outline of a configuration of the signal driver shown in FIG. 1.

The signal driver 30 includes a shift register 32, line latches 34 and 36, a digital-analog converter circuit (drive voltage generation circuit in a broad sense) 38, and a signal line drive circuit 40.

The shift register 32 includes a plurality of flip-flops. These flip-flops are connected sequentially. The shift register 32 holds an enable input/output signal EIO in synchronization with a clock signal CLK, and sequentially shifts the enable input/output signal EIO to the adjacent flip-flop in synchronization with the clock signal CLK.

A shift direction switch signal SHL is supplied to the shift register 32. The shift direction of the image data (DIO) and the input/output direction of the enable input/output signal EIO of the shift register 32 are switched by the shift direction switch signal SHL. Therefore, even if the position of the LCD controller 60 which supplies the image data to the signal driver 30 differs depending upon the mounting conditions of the signal driver 30, flexible mounting can be achieved without increasing the mounting area due to routing of interconnects by switching the shift direction using the shift direction switch signal SHL.

The image data (DIO) is input to the line latch 34 from the LCD controller 60 in a unit of 18 bits (6 bits (gradation data)×3 (RGB)), for example. The line latch 34 latches the image data (DIO) in synchronization with the enable input/output signal EIO sequentially shifted by the flip-flops of the shift register 32.

The line latch 36 latches the image data (DIO) for one horizontal scan latched by the line latch 34 in synchronization with the horizontal synchronization signal LP supplied from the LCD controller 60.

The DAC 38 generates the drive voltage converted into analog based on the image data for each signal line.

The signal line drive circuit 40 drives the signal lines based on the drive voltage generated by the DAC 38.

The signal driver 30 sequentially captures a given unit (18-bit unit, for example) of image data input from the LCD controller 60, and sequentially holds the image data for one horizontal scan in the line latch 36 in synchronization with the horizontal synchronization signal LP. The signal driver 30 drives each signal line based on the image data. As a result, the drive voltage based on the image data is supplied to the source electrode of the TFT of the LCD panel 20.

(Scanning Driver)

Figure 3:
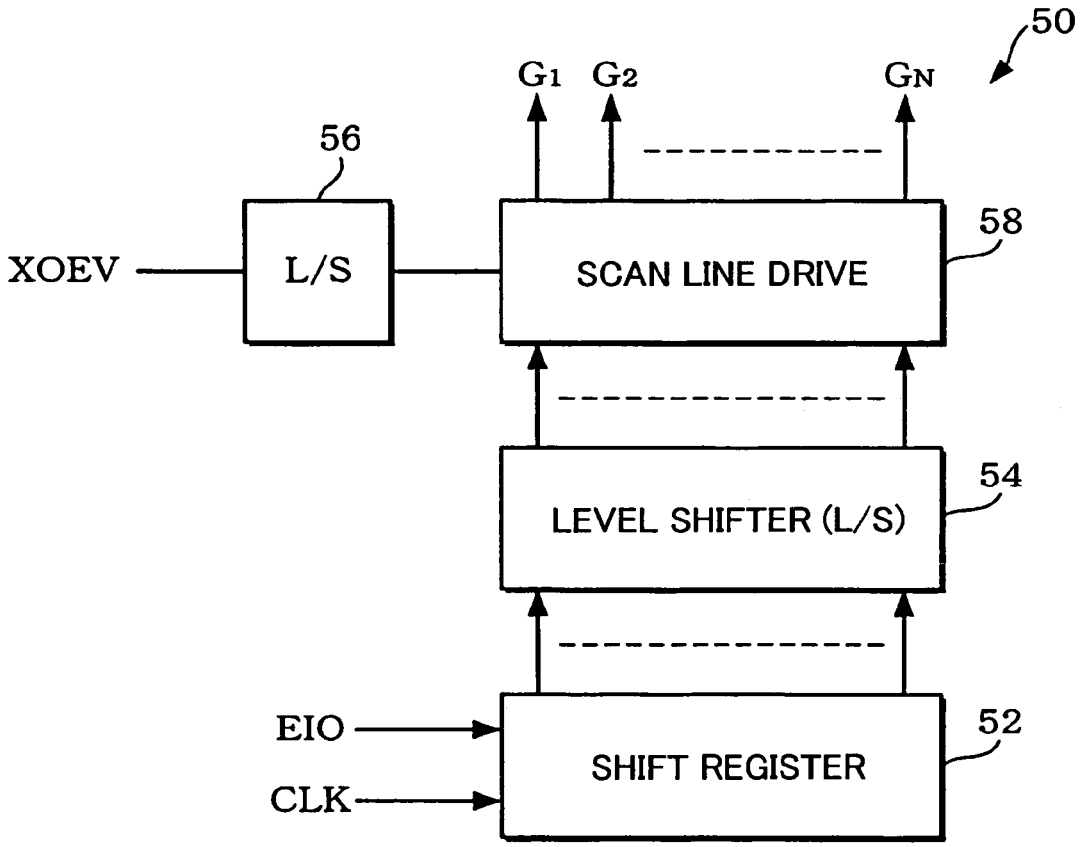
FIG. 3 is a block diagram schematically showing a scanning driver shown in FIG. 1.

FIG. 3 shows an outline of a configuration of the scanning driver shown in FIG. 1.

The scanning driver 50 includes a shift register 52, level shifters (hereinafter abbreviated as "L/S") 54 and 56, and a scan line drive circuit 58.

In the shift register 52, flip-flops provided corresponding to each scan line are connected sequentially. The shift register 52 holds the enable input/output signal EIO in the flip-flop in synchronization with the clock signal CLK, and sequentially shifts the enable input/output signal EIO to the adjacent flip-flop in synchronization with the clock signal CLK. The enable input/output signal EIO input to the shift register 52 is a vertical synchronization signal supplied from the LCD controller 60.

The L/S 54 shifts the voltage level to a level corresponding to the liquid crystal material for the LCD panel 20 and transistor performance of the TFT. Since a high voltage level of 20–50 V is necessary for this voltage level, a high breakdown voltage process differing from that of other logic circuit sections is used.

The scan line drive circuit 58 performs CMOS drive based on the drive voltage shifted by the L/S 54. The scanning driver 50 includes the L/S 56 which shifts the voltage level of an output enable signal XOEV supplied from the LCD controller 60. The scan line drive circuit 58 is ON-OFF controlled by the output enable signal XOEV shifted by the L/S 56.

In the scanning driver 50, the enable input/output signal EIO input as the vertical synchronization signal is sequentially shifted to each of the flip-flops of the shift register 52 in synchronization with the clock signal CLK. Since each of the flip-flops of the shift register 52 is provided corresponding to each scan line, the scan line is selectively and sequentially selected by a pulse of the vertical synchronization signal held by each of the flip-flops. The selected scan line is driven by the scan line drive circuit 58 at a voltage level shifted by the L/S 54. This allows a given scanning voltage to be supplied to the gate electrode of the TFT of the LCD panel 20 at one vertical scanning cycle. At this time, the potential of the drain electrode of the TFT of the LCD panel 20 is almost equal to the potential of the signal line connected to the source electrode.

(LCD Controller)

Figure 4:
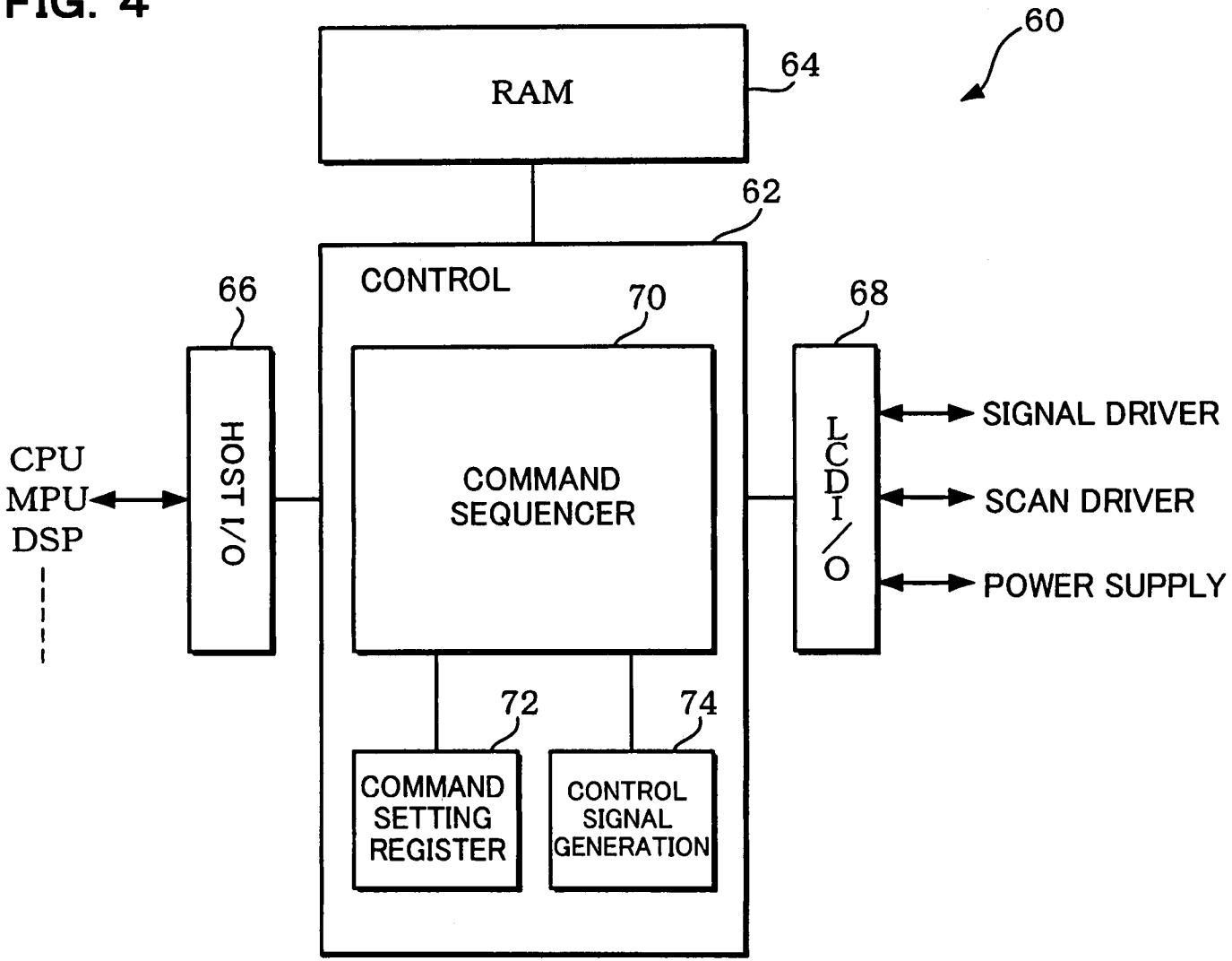
FIG. 4 is a block diagram schematically showing an LCD controller shown in FIG. 1.

FIG. 4 shows an outline of a configuration of the LCD controller shown in FIG. 1.

The LCD controller 60 includes a control circuit 62, a random access memory (hereinafter abbreviated as "RAM") (memory circuit in a broad sense) 64, a host input/output circuit (I/O) 66, and an LCD input/output circuit 68. The control circuit 62 includes a command sequencer 70, a command setting register 72, and a control signal generation circuit 74.

The control circuit 62 sets various types of operation modes and performs synchronization control or the like of the signal driver 30, scanning driver 50, and power supply circuit 80 according to the content set by the host. More specifically, the command sequencer 70 generates synchronization timing using the control signal generation circuit 74 or sets a given operation mode of the signal driver and the like based on the content set in the command setting register 72 according to instructions from the host.

The RAM 64 functions as a frame buffer for displaying the image and as a work area of the control circuit 62.

Image data and command data for controlling the signal driver 30 and the scanning driver 50 are supplied to the LCD controller 60 through the host I/O 66. The host I/O 66 is connected with a CPU, a digital signal processor (DSP), or a micro processor unit (MPU) (not shown).

Still image data from the CPU (not shown) or video data from the DSP or MPU is supplied to the LCD controller 60 as the image data. The content of the register for controlling the signal driver 30 or scanning driver 50, or data for setting various types of operation modes is supplied to the LCD controller 60 as the command data from the CPU (not shown).

The image data and the command data may be supplied through different data buses, or the data bus may be shared. In the latter case, the image data and the command data can be easily shared by enabling the data on the data bus to be identified as either the image data or command data by the signal level input to a command (CMD) terminal, for example. This enables the mounting area to be reduced.

When the image data is supplied to the LCD controller 60, the LCD controller 60 holds this image data in the RAM 64 as a frame buffer. When the command data is supplied to the LCD controller 60, the LCD controller 60 holds the command data in the command setting register 72 or in the RAM 64.

The command sequencer 70 generates various types of timing signals by the control signal generation circuit 74 according to the content of the command setting register 72. The command sequencer 70 sets the mode of the signal driver 30, scanning driver 50, or power supply circuit 80 through the LCD input/output circuit 68 according to the content of the command setting register 72.

The command sequencer 70 generates the image data in a given format from the image data stored in the RAM 64 by the display timing generated by the control signal generation circuit 74, and supplies the image data to the signal driver 30 through the LCD input/output circuit 68.

1.2 Inversion Drive Method

In the case of driving a liquid crystal, charges stored in the liquid crystal capacitances must be discharged periodically from the viewpoint of durability of the liquid crystal and the contrast. Therefore, in the liquid crystal device 10, polarity of the voltage applied to the liquid crystal is reversed in a given cycle using AC driving. As the AC drive method, a frame inversion drive method, a line inversion drive method, and the like can be given.

In the frame inversion drive method, polarity of the voltage applied to the liquid crystal capacitances is reversed in each frame. In the line inversion drive method, polarity of the voltage applied to the liquid crystal capacitances is reversed in each line. In the line inversion drive method, polarity of the voltage applied to the liquid crystal capacitances is reversed in each line in a frame cycle.

Figure 5A:
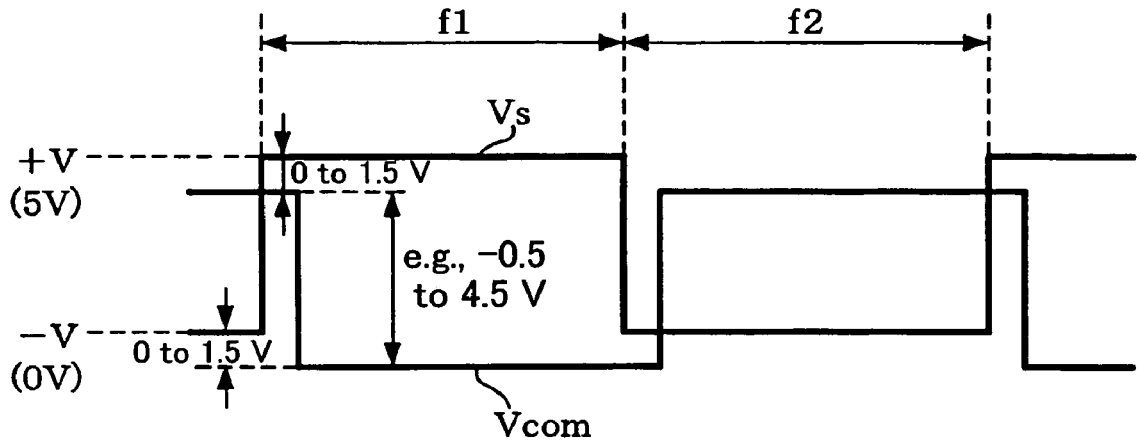
FIG. 5A shows waveforms of a drive voltage for the signal lines and a common electrode voltage Vcom according to a frame inversion drive method, and FIG. 5B schematically shows the polarity of a voltage to be applied to the liquid crystal capacitance corresponding to each pixel in each frame in the case of performing the frame inversion drive method.
Figure 5B:
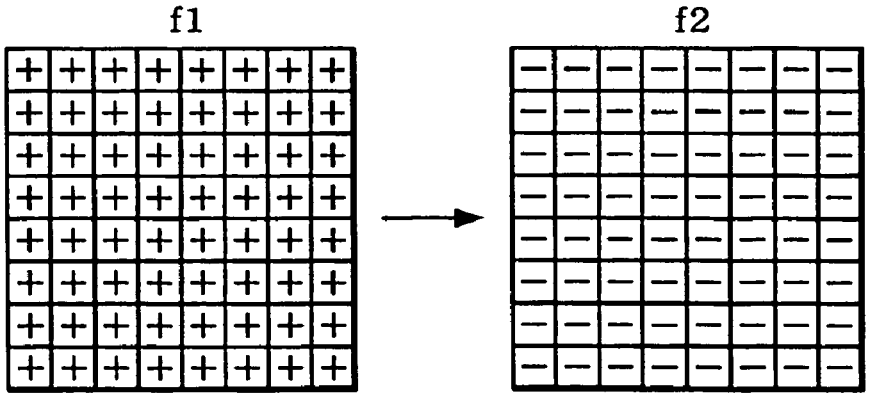

FIGS. 5A and 5B are views for describing the operation of the frame inversion drive method. FIG. 5A schematically shows waveforms of the drive voltage of the signal line and the common electrode voltage Vcom using the frame inversion drive method. FIG. 5B schematically shows the polarity of the voltage applied to the liquid crystal capacitances corresponding to each pixel in each frame in the case of using the frame inversion drive method.

In the frame inversion drive method, the polarity of the drive voltage applied to the signal lines is reversed in a frame cycle, as shown in FIG. 5A. Specifically, a voltage VS supplied to the source electrodes of the TFTs connected to the signal lines is positive (+V) in a frame f1 and negative (−V) in a frame f2. The polarity of the common electrode voltage Vcom supplied to the common electrodes opposite to the pixel electrodes connected to the drain electrodes of the TFTs is also reversed in synchronization with a polarization inversion cycle of the drive voltage of the signal lines.

Since the difference in the voltage between the pixel electrode and the common electrode is applied to the liquid crystal capacitances, a positive voltage is applied in the frame f1 and a negative voltage is applied in the frame 2, as shown in FIG. 5B.

Figure 6A:
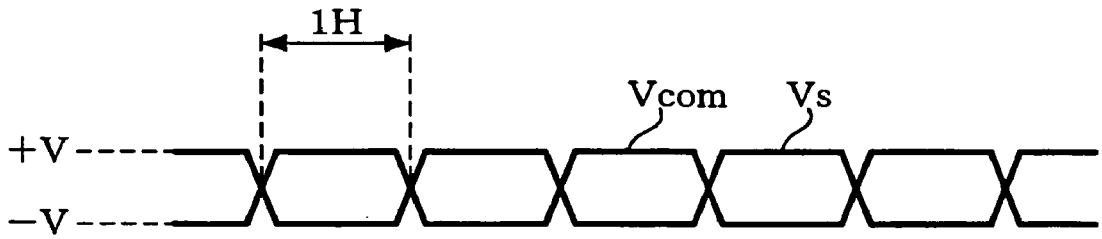
FIG. 6A shows waveforms of a drive voltage for the signal lines and a common electrode voltage Vcom according to a line inversion drive method, and FIG. 6B schematically shows the polarity of a voltage to be applied to the liquid crystal capacitance corresponding to each pixel in each frame in the case of performing the line inversion drive method.
Figure 6B:
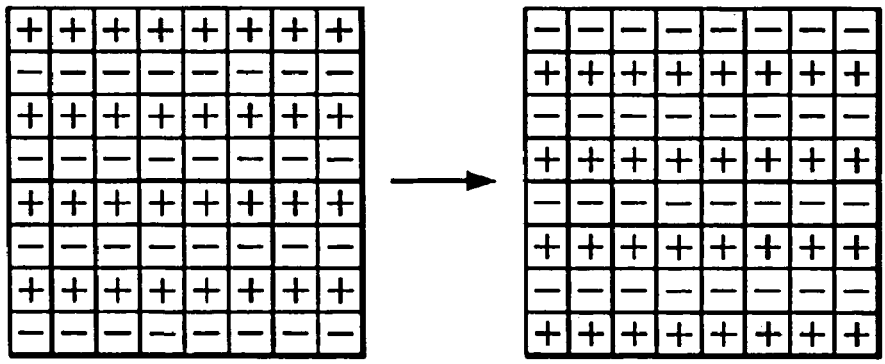

FIGS. 6A and 6B are views for describing the operation of the line inversion drive method.

FIG. 6A schematically shows the waveforms of the drive voltage of the signal lines and the common electrode voltage Vcom using the line inversion drive method. FIG. 6B schematically shows the polarity of the voltage applied to the liquid crystal capacitances corresponding to each pixel in each line in the case of performing the line inversion drive method.

In the line inversion drive method, the polarity of the drive voltage applied to the signal lines is reversed in one horizontal scanning cycle (1H) and in one frame cycle, as shown in FIG. 6A. Specifically, the voltage VS supplied to the source electrodes of the TFTs connected to the signal lines is positive (+V) at 1H and negative (−V) at 2H in the frame f1. The voltage VS is negative (−V) at the 1H and positive (+V) at the 2H in the frame f2.

The polarity of the common electrode voltage Vcom supplied to the common electrode opposite to the pixel electrode connected to the drain electrode of the TFT is also reversed in synchronization with the polarization inversion cycle of the drive voltage of the signal lines.

Since the difference in the voltage between the pixel electrode and the common electrode is applied to the liquid crystal capacitances, a voltage of which the polarity is reversed in each line is applied in the frame cycle by reversing the polarity in each scan line, as shown in FIG. 6B.

Generally, the line inversion drive method contributes to improvement of the image quality in comparison with the frame inversion drive method, since the polarity is reversed in one line cycle. However, power consumption is increased in the line inversion drive method.

1.3 Liquid Crystal Drive Waveform

Figure 7:
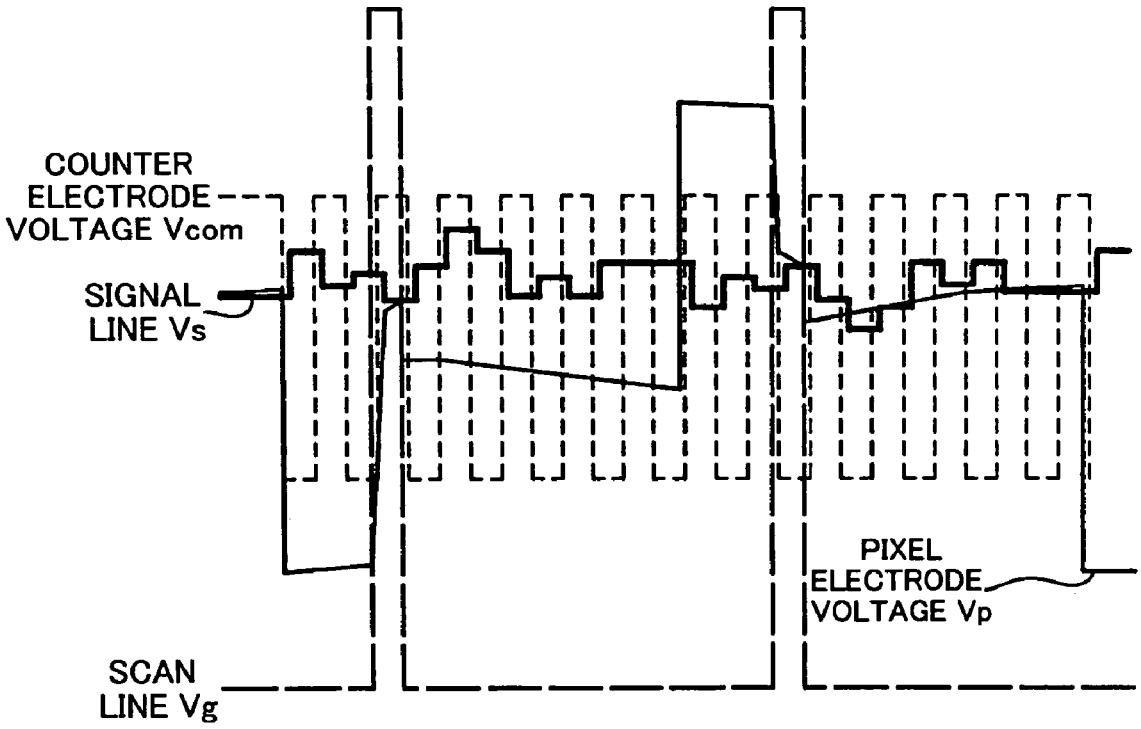
FIG. 7 shows drive waveforms of the LCD panel of the liquid crystal device.

FIG. 7 shows an example of the drive waveform of the LCD panel 20 of the liquid crystal device 10 having the above configuration. This example shows a case of driving the liquid crystal using the line inversion drive method.

In the liquid crystal device 10, the signal driver 30, scanning driver 50, and power supply circuit 80 are controlled according to the display timing generated by the LCD controller 60. The LCD controller 60 sequentially transfers the image data for one horizontal scan to the signal driver 30, and supplies the horizontal synchronization signal or polarization inversion signal POL which indicates an inversion drive timing generated therein. The LCD controller 60 supplies the vertical synchronization signal generated therein to the scanning driver 50. The LCD controller 60 supplies a common electrode voltage polarization inversion signal VCOM to the power supply circuit 80.

The signal driver 30 drives the signal lines based on the image data for one horizontal scan in synchronization with the horizontal synchronization signal. The scanning driver 50 sequentially drives the scan lines connected to the gate electrodes of the TFTs disposed on the LCD panel 20 in a matrix by the drive voltage Vg when triggered by the vertical synchronization signal. The power supply circuit 80 supplies the common electrode voltage Vcom generated therein to each common electrode of the LCD panel 20 while reversing the polarity in synchronization with the common electrode voltage polarization inversion signal VCOM.

Charges corresponding to the difference between the voltage of the pixel electrode connected to the drain electrode of the TFT and the common electrode voltage Vcom are charged in the liquid crystal capacitances. Therefore, an image can be displayed when the pixel electrode voltage Vp held by the charges stored in the liquid crystal capacitances exceeds a given threshold value VCL. When the pixel electrode voltage Vp exceeds the threshold value VCL, the transmittance of the pixel is changed corresponding to the voltage level, thereby enabling a gradational display.

2. Signal Driver 2.1 High Impedance Control in Units of Blocks

Figure 8A:
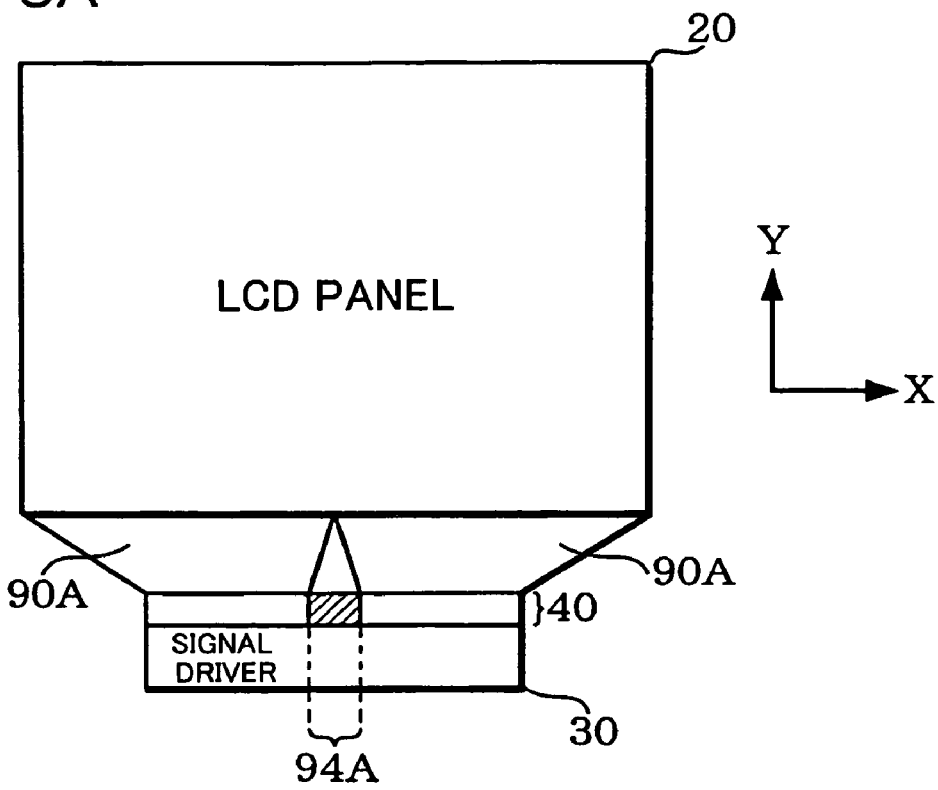
FIGS. 8A and 8B schematically show the connection between the LCD panel and the signal driver.
Figure 8B:
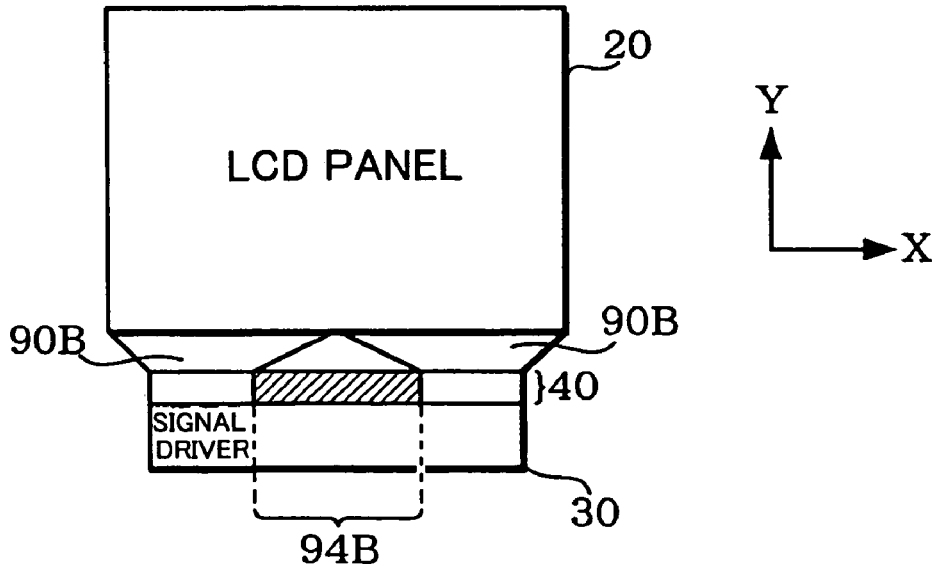

FIGS. 8A and 8B schematically show the connection relation between the size of the LCD panel 20 and the signal driver 30 of the present embodiment.

In the case where a plurality of signal lines extending in the Y axial direction of the LCD panel 20 is arranged in the X direction, the signal line drive circuit 40 of the signal driver 30 which drives the signal lines is generally disposed in the direction of the long side of the LCD panel 20. In the case where the number D of the outputs of the signal driver 30 is larger than the number N of the signal lines of the LCD panel 20, the signal lines of the LCD panel 20 and the signal line drive circuit of the signal driver 30 are connected through interconnects while allowing a signal line drive circuit 94A near the center excluding the right and left edge portions to remain unconnected. This enables the distance between the LCD panel 20 and the signal driver 30 to be decreased while reducing the length of the interconnects. As a result, an interconnection area 90A can be effectively used, whereby the mounting area can be reduced.

In the case where the size of the LCD panel 20 is large as shown in FIG. 8A, the outputs of the signal line drive circuit 94A near the center excluding the right and left edge portions are controlled into a high impedance state when using the signal line drive circuit for the number of signal lines corresponding to the panel size.

In the case where the size of the LCD panel 20 is small as shown in FIG. 8B, the outputs of a signal line drive circuit 94B are controlled into a high impedance state by disposing excess signal line drive circuits increased in comparison with the case shown in FIG. 8A near the center excluding the right and left edge portions.

Therefore, in the signal driver 30, when the signal lines are divided into blocks each of which including a given number of signal lines, an output of the signal line drive circuit in the optionally selected block can be controlled into a high impedance state. Therefore, the signal driver 30 includes a block output select register which holds block output select data (control instruction data in a broad sense) for setting whether or not to control the outputs of the signal line drive circuit which drives the signal lines in each block into a high impedance state. The signal lines in a block in which the high impedance control is permitted by the block output select data are driven by the signal line drive circuit. The signal lines in a block in which the high impedance control is prohibited are controlled in a high impedance state. Therefore, it is possible to easily deal with the change in the size of the LCD panel 20 by only changing the signal line drive circuit of which the outputs are controlled into a high impedance state. This reduces current consumption accompanied by impedance conversion performed in the signal line drive circuit which need not be driven. Moreover, the length of each interconnect layer connected to the signal lines of the LCD panel 20 can be made uniform by disposing the signal line drive circuit of which the outputs are controlled into a high impedance state near the center excluding the right and left edge portions.

2.2 Bypass Input of Image Data

In the case where the outputs of the signal line drive circuit in the block selected corresponding to the size of the LCD panel 20 are set to be controlled into a high impedance state, the following problem occurs.

Figure 9:
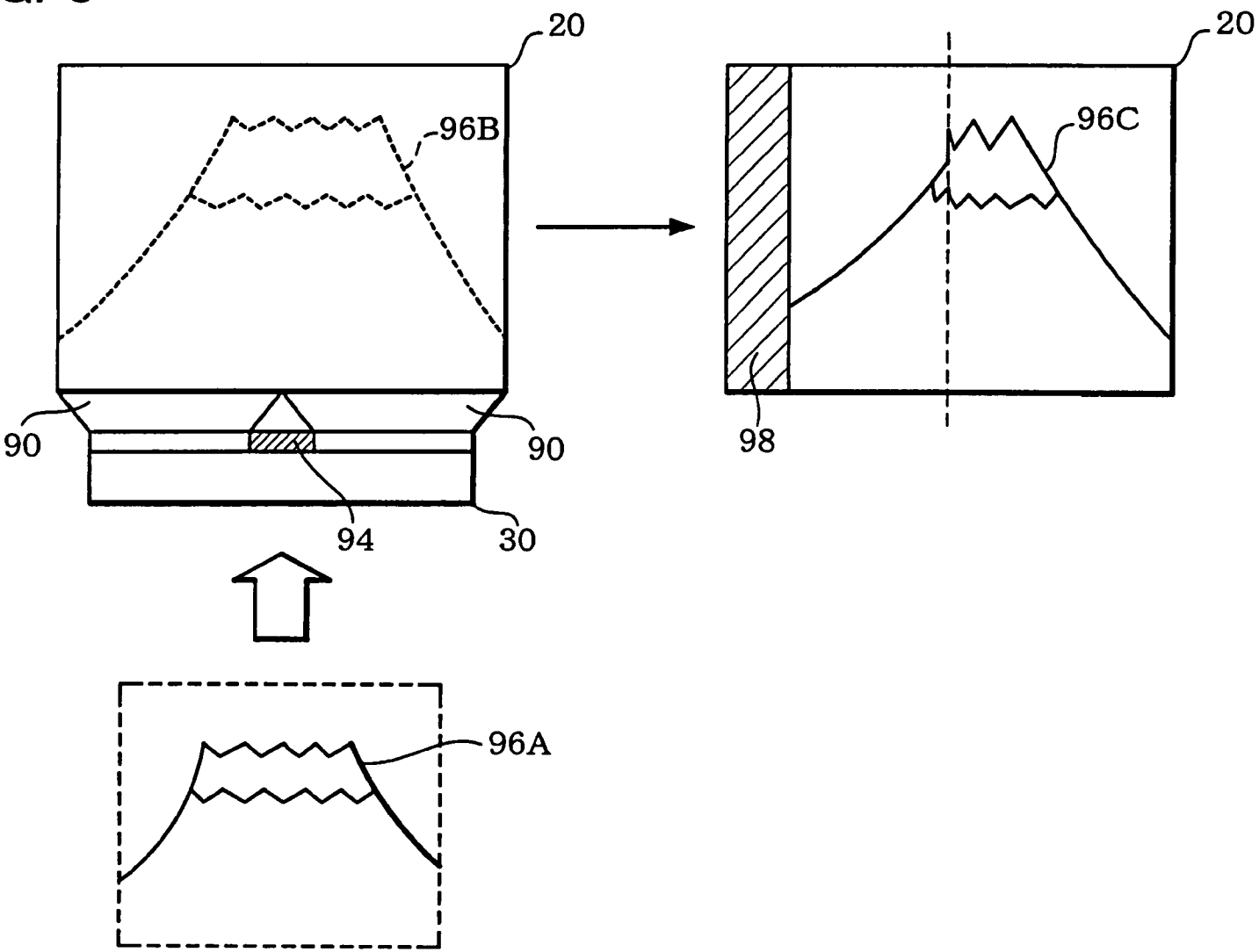
FIG. 9 is illustrative of a problem when one frame of an image is displayed on the LCD panel.

FIG. 9 is a view for describing the problem occurring when displaying one image frame on the LCD panel 20.

For example, the signal lines of the LCD panel 20 and the signal line drive circuit of the signal driver 30 are connected through the interconnects without connecting the signal line drive circuit 94 near the center of the signal driver 30, as shown in FIG. 8.

In the case where such a signal driver 30 drives the signal lines based on one frame of image data 96A created by the user, an image 96B should be displayed in the LCD panel 20. However, an image 96C is displayed in the LCD panel 20 due to the signal line drive circuit 94 of which the outputs are controlled into a high impedance state present near the center, whereby a non-display area 98 is formed on the edge of the LCD panel 20.

Specifically, an image which is not intended by the user is displayed when the image data is supplied to the signal line drive circuit 94 corresponding to the signal lines to which the image data should not be supplied, and the signal lines are driven in a state in which the image data is not supplied to the signal line drive circuit corresponding to the signal lines to which the image data should be supplied. Therefore, in order to display the intended image in the LCD panel 20, the user must supply the image data to the signal driver 30 while recognizing the block of which the outputs are controlled into a high impedance state.

However, it is extremely inconvenient for the user to change the image data to be supplied depending upon the mounting conditions.

Therefore, the signal driver 30 is designed so that the flip-flops corresponding to the signal lines in the block of which the outputs are set to be in a high impedance state is bypassed and the image data is sequentially shifted to the flip-flops corresponding to the scan lines in the next block when sequentially shifting and capturing the image data in order to latch the image data for one horizontal scan.

Figure 10A:
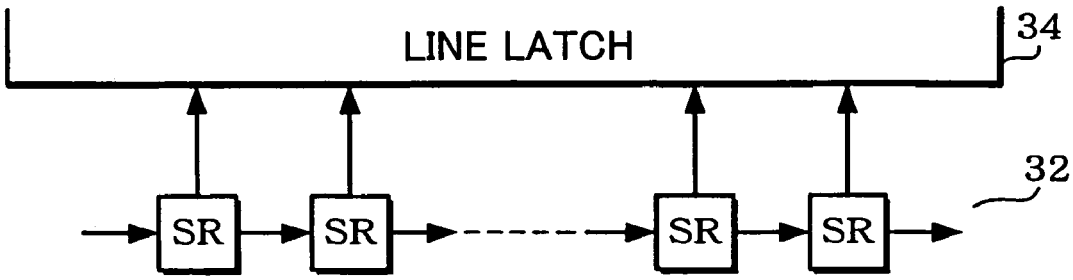
FIGS. 10A and 10B show examples of bypass operation of image data according to one embodiment of the present invention.
Figure 10B:
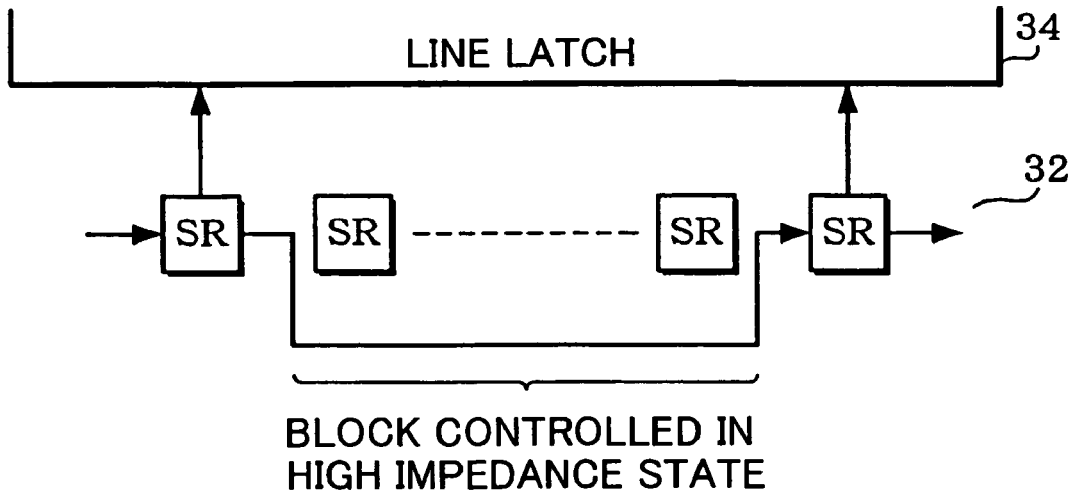

FIGS. 10A and 10B show an example of the bypass operation of the image data.

In the case where the outputs of each block are not set to be controlled into a high impedance state, the image data captured in the signal driver 30 is sequentially shifted in the shift register 32, as shown in FIG. 10A.

In this embodiment, the shift registers corresponding to the signal lines in the block of which the outputs are controlled into a high impedance state are bypassed, and the image data is supplied to the shift registers corresponding to the signal lines in the block of which the outputs are not controlled in a high impedance state.

This eliminates the need for the user to change the image data to be supplied even if the setting of the block of which the outputs are controlled into a high impedance state is changed depending upon the mounting conditions. Therefore, a liquid crystal device convenient for the user can be provided.

2.3 Output Control in Units of Blocks

The signal driver 30 enables a partial display by driving the signal based on the image data in units of blocks divided for a given number of signal lines. Therefore, the signal driver 30 includes a partial display select register which holds partial display data indicating whether or not to allow the output of each block in units of blocks. A block in which output is permitted by the partial display data is set to be a display area in which the signal based on the image data is driven through the signal lines in the block. A block in which display is prohibited by the partial display data is set to be a non-display area in which a given non-display level voltage is supplied to the signal lines in the block.

In this embodiment, the block is in a 8-pixel unit. One pixel consists of 3 bits of RGB signals. Therefore, one block of the signal driver 30 has 24 outputs (S1 to S24, for example). This enables the display area of the LCD panel 20 to be set in a character (one byte) unit, whereby efficient setting of the display area and the display of the image can be achieved in electronic equipment which displays characters such as a portable telephone.

Figure 11A:
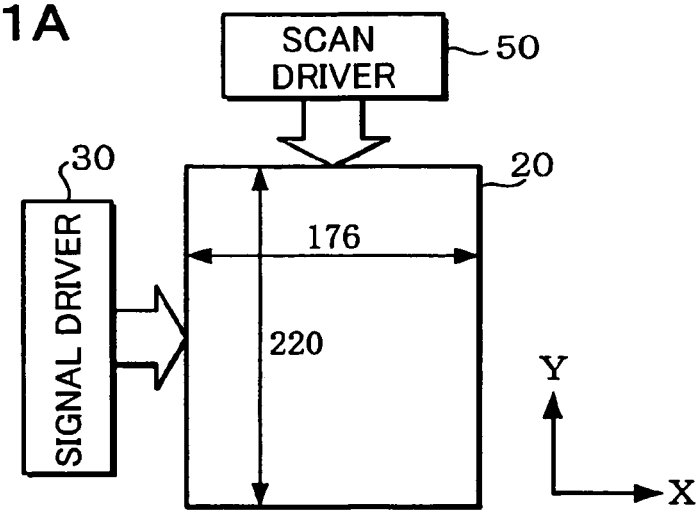
FIGS. 11A, 11B and 11C show an example of a partial display implemented by the signal driver according to one embodiment of the present invention.
Figure 11B:
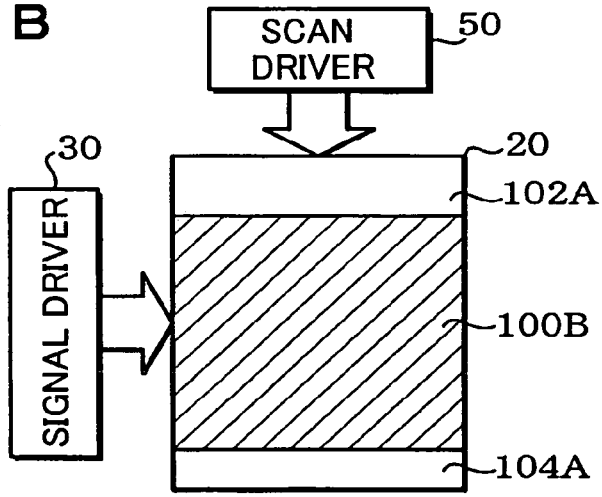
Figure 11C:
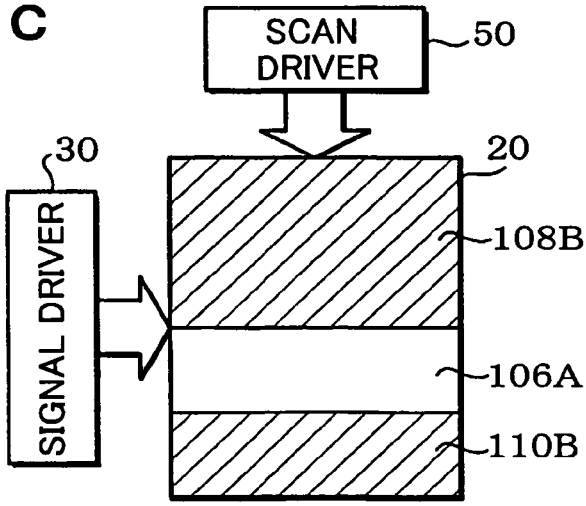

FIGS. 11A, 11B, and 11C are views schematically showing an example of the partial display realized by the signal driver of this embodiment.

As shown in FIG. 11A, in the case where the signal driver 30 is disposed so that a plurality of signal lines is arranged in the Y direction, and the scanning driver 50 is disposed so that a plurality of scan lines is arranged in the X direction, a non-display area 100B of the LCD panel 20 is set in units of blocks as shown in FIG. 11B. In this case, only the signal lines in the blocks corresponding to display areas 102A and 104A are driven based on the image data.

In the case where a display area 106A is set in units of blocks as shown in FIG. 11C, the signal lines in the blocks corresponding to non-display areas 108B and 110B need not be driven based on the image data. In FIGS. 11B and 11C, a plurality of non-display areas or a plurality of display areas may be provided.

Figure 12A:
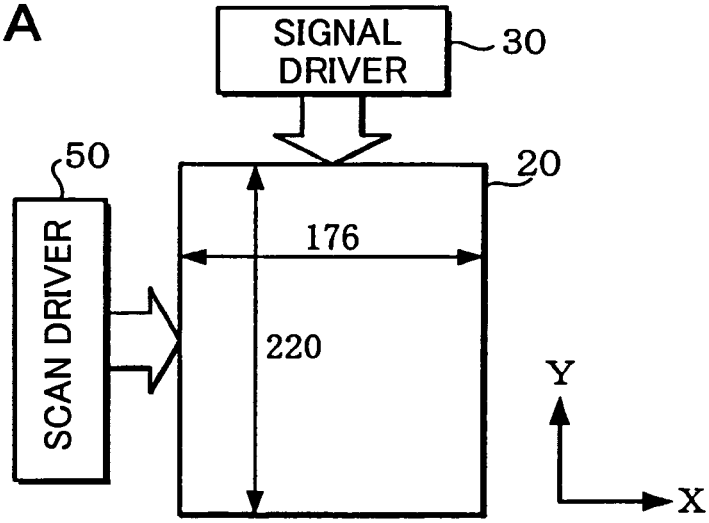
FIGS. 12A, 12B and 12C show another example of a partial display implemented by the signal driver of the present embodiment.
Figure 12B:
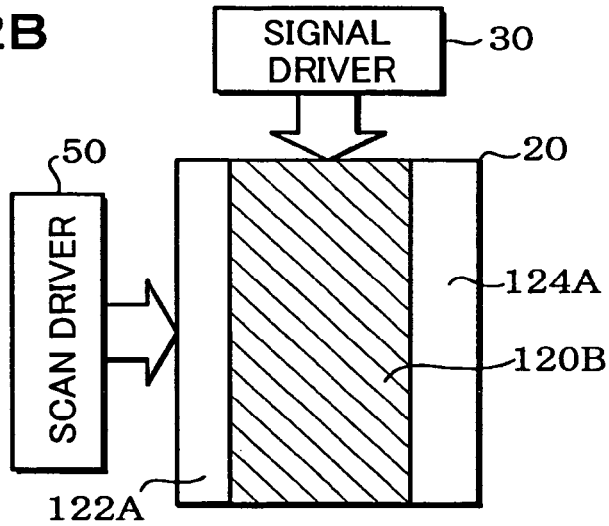
Figure 12C:
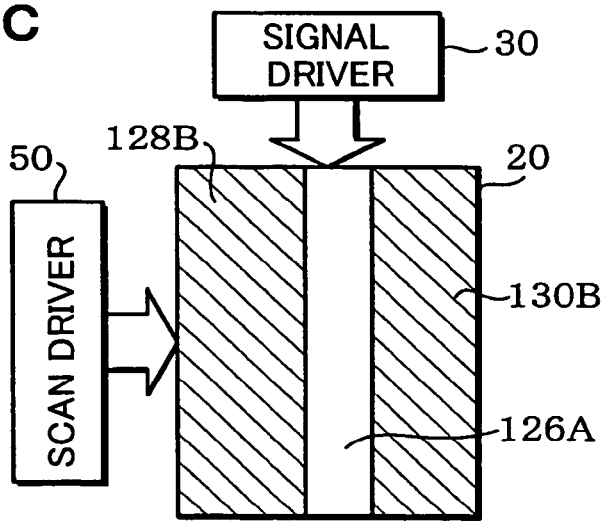

FIGS. 12A, 12B, and 12C schematically show another example of the partial display realized by the signal driver.

As shown in FIG. 12A, in the case where the signal driver 30 is disposed so that a plurality of signal lines is arranged in the X direction and the scanning driver 50 is disposed so that a plurality of scan lines is arranged in the Y direction, only the signal lines in the blocks corresponding to display areas 122A and 124A are driven based on the image data by setting a non-display area 120B of the LCD panel 20 in units of blocks as shown in FIG. 12B.

In the case where a display area 126A is set in units of blocks as shown in FIG. 12C, the signal lines in the blocks corresponding to non-display areas 128B and 130B need not be driven based on the image data. In FIGS. 12B and 12C, a plurality of non-display areas or a plurality of display areas may be set.

Each of the display areas may be divided into a still image display area and a video display area, for example. This enables the provision of a screen convenient for the user and a decrease in the power consumption.

In the signal driver 30, the signal line drive circuit 40 is controlled in units of blocks, and drives the signal lines in the blocks using a voltage-follower-connected operational amplifier or a non-display-level voltage supply circuit.

Figure 13A:
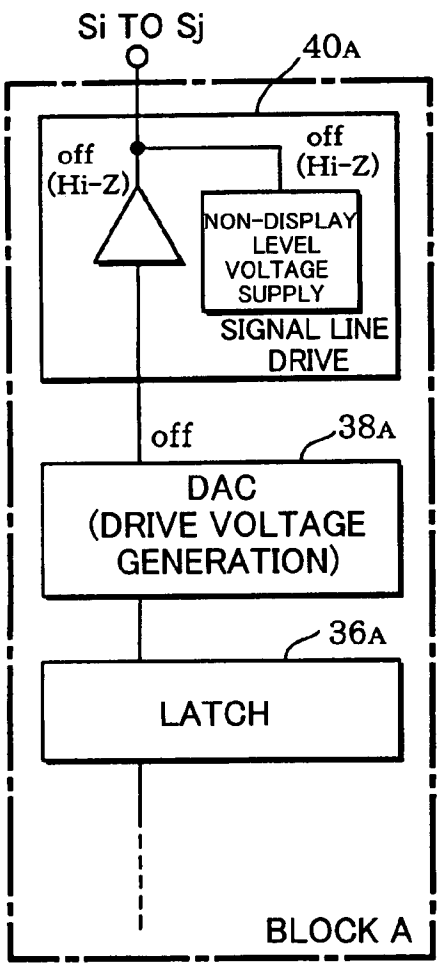
FIGS. 13A, 13B, and 13C are illustrative of the control by the signal line drive circuit according to one embodiment of the present invention.
Figure 13B:
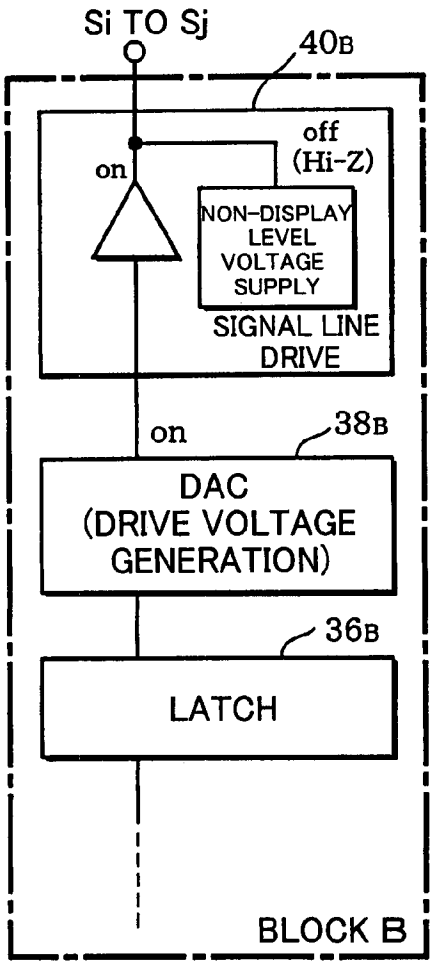
Figure 13C:
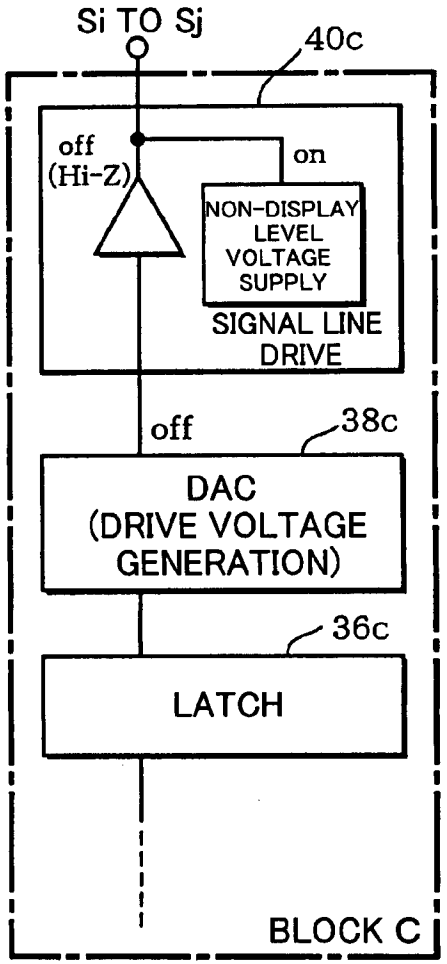

FIGS. 13A, 13B, and 13C are views schematically showing the control content of the signal line drive circuit of this embodiment.

As shown in FIG. 13A, generation control of the drive voltage by a DAC 38A to the signal lines in the block of which the outputs are controlled in a high impedance state by the block output select data (control instruction data) is terminated, and the output of the voltage-follower-connected operational amplifier is controlled in a high impedance state in a signal line drive circuit 40A. The output of the non-display-level voltage supply circuit of the signal line drive circuit 40A is controlled in a high impedance state.

In the case of driving the signal lines in the block of which the outputs are not controlled in a high impedance state by the block output select data (control instruction data) and which corresponds to the display area in which output is permitted by the partial display data based on the image data, one or more signal lines assigned to the block are driven by generating the drive voltage by a DAC 38B and converting the impedance by the voltage-follower-connected operational amplifier in a signal line drive circuit 40B, as shown in FIG. 13B. The output of the non-display-level voltage supply circuit of the signal line drive circuit 40B is controlled into a high impedance state.

In the case of the signal lines in the block of which the outputs are not controlled into a high impedance state by the block output select data (control instruction data) and which corresponds to the non-display area in which output is prohibited by the partial display data, generation control of the drive voltage by a DAC 38C is terminated and the output of the voltage-follower-connected operational amplifier in a signal line drive circuit 40C is controlled into a high impedance state, as shown in FIG. 13C. One or more signal lines assigned to the block are driven by the non-display-level voltage generated by the non-display-level voltage supply circuit of the signal line drive circuit 40C. The non-display-level voltage is set at a voltage level which causes the voltage applied to the liquid crystal capacitance connected to the TFT to be smaller than the threshold value VCL at which the display is enabled due to at least the change of the transmittance of the pixels.

This decreases the continuous current consumption by the operational amplifier while achieving the above-described effects by the image display. Therefore, power consumption of the active matrix type liquid crystal panel using a TFT liquid crystal can be decreased, whereby the liquid crystal panel can be installed in battery-driven portable electronic equipment.

2.4 Arrangement of Blocks Depending on Shift Direction

As shown in FIGS. 11A to 11C and 12A to 12C, the signal driver 30 may be disposed at a different position with respect to the LCD panel 20 depending upon the electronic equipment in which the signal driver is installed.

Figure 14A:
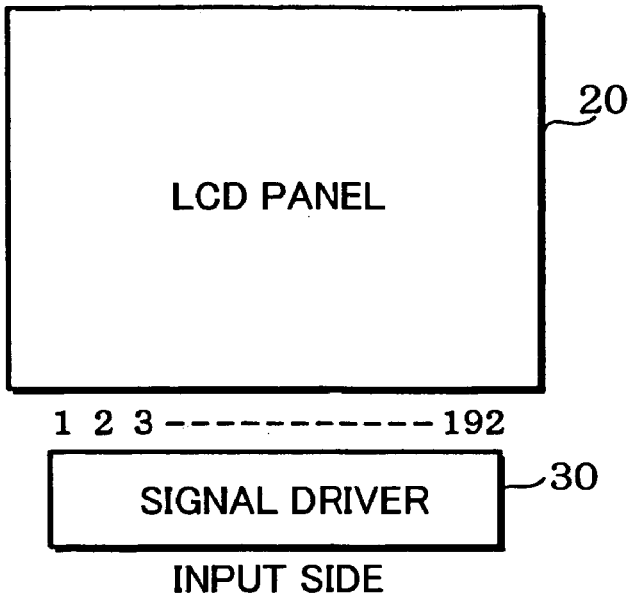
FIGS. 14A and 14B schematically show the signal driver disposed at different positions with respect to the LCD panel.
Figure 14B:
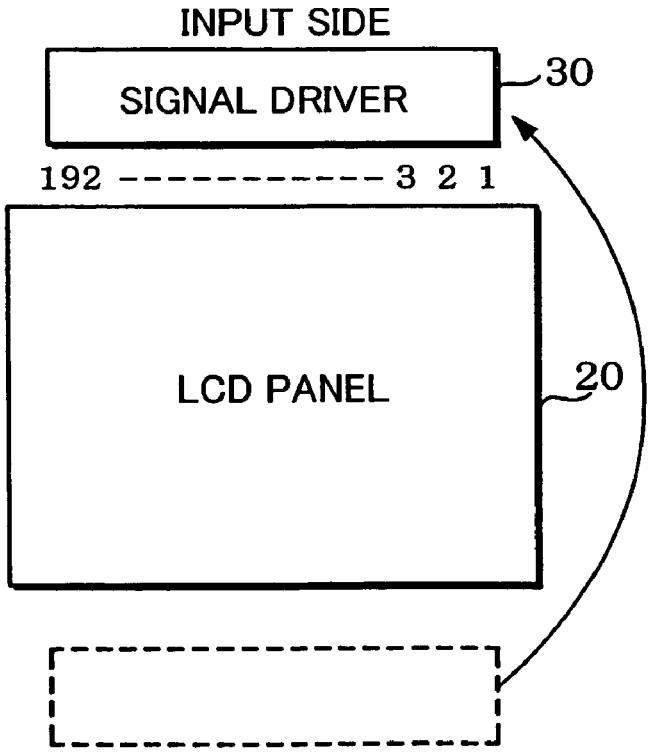

FIGS. 14A and 14B are views schematically showing the signal driver 30 mounted at a different position with respect to the LCD panel 20.

Specifically, the signal driver 30 is disposed below the LCD panel 20 in the example shown in FIG. 14A. In the example shown in FIG. 14B, the signal driver 30 is disposed above the LCD panel 20.

Since the signal line drive output side of the signal driver 30 is fixed, the order of the outputs of the signal driver 30 disposed below the LCD panel 20 (FIG. 14A) is the reverse of the order of the outputs of the signal driver 30 disposed above the LCD panel 20 (FIG. 14B). Therefore, the mounting area may be increased due to routing of the interconnects to the signal driver 30 depending upon the mounting conditions. To deal with this problem, the shift direction of the image data is switched by a shift direction switch signal SHL.

FIGS. 15A, 15B, and 15C are views schematically showing the corresponding relation between the image data held by the line latch and the blocks.

For example, in the case where the signal driver 30 is disposed at the position shown in FIG. 14A, the image data for one horizontal scan sequentially held by the shift register and latched in the line latch 36 is arranged in the order of P1 to PM corresponding to the signal lines S1 to SM by setting the shift direction switch signal SHL to "H", as shown in FIG. 15A.

In the case where the signal driver 30 is disposed at the position shown in FIG. 14B, the image data supplied from the LCD controller 60 in the same order as that shown in FIG. 15A is held in the line latch 36 in the order of PM, . . . P3, P2, P1 corresponding to the signal lines S1 to SM by setting the shift direction switch signal SHL to "L", as shown in FIG. 15B.

However, the order of the blocks consisting of a plurality of signal lines is not changed for the user, as shown in FIGS. 15A and 15B. Therefore, in the case of controlling the image data in units of blocks, the user must control the image display while recognizing that the order of the blocks is changed corresponding to the shift direction.

Therefore, in this embodiment, the order of the partial display data designated in units of blocks is changed corresponding to the shift direction as shown in FIG. 15C in order to enable partial display control in units of blocks without allowing the user to take into consideration the order of the blocks changed by the shift direction. Specifically, the signal driver 30 includes a block data rearrangement circuit capable of reversing the order of the partial display data stored in the partial display select register when the shift direction is switched.

This enables switching of the partial display in units of blocks to be realized irrespective of the mounting conditions of the signal driver 30 while maintaining the corresponding relation between the blocks in which the display area and non-display area are set and the drive circuit of the actual panel.

An example of configuration of the signal driver 30 is described below.

3. Signal Driver 3.1 Configuration in a Block

Figure 16:
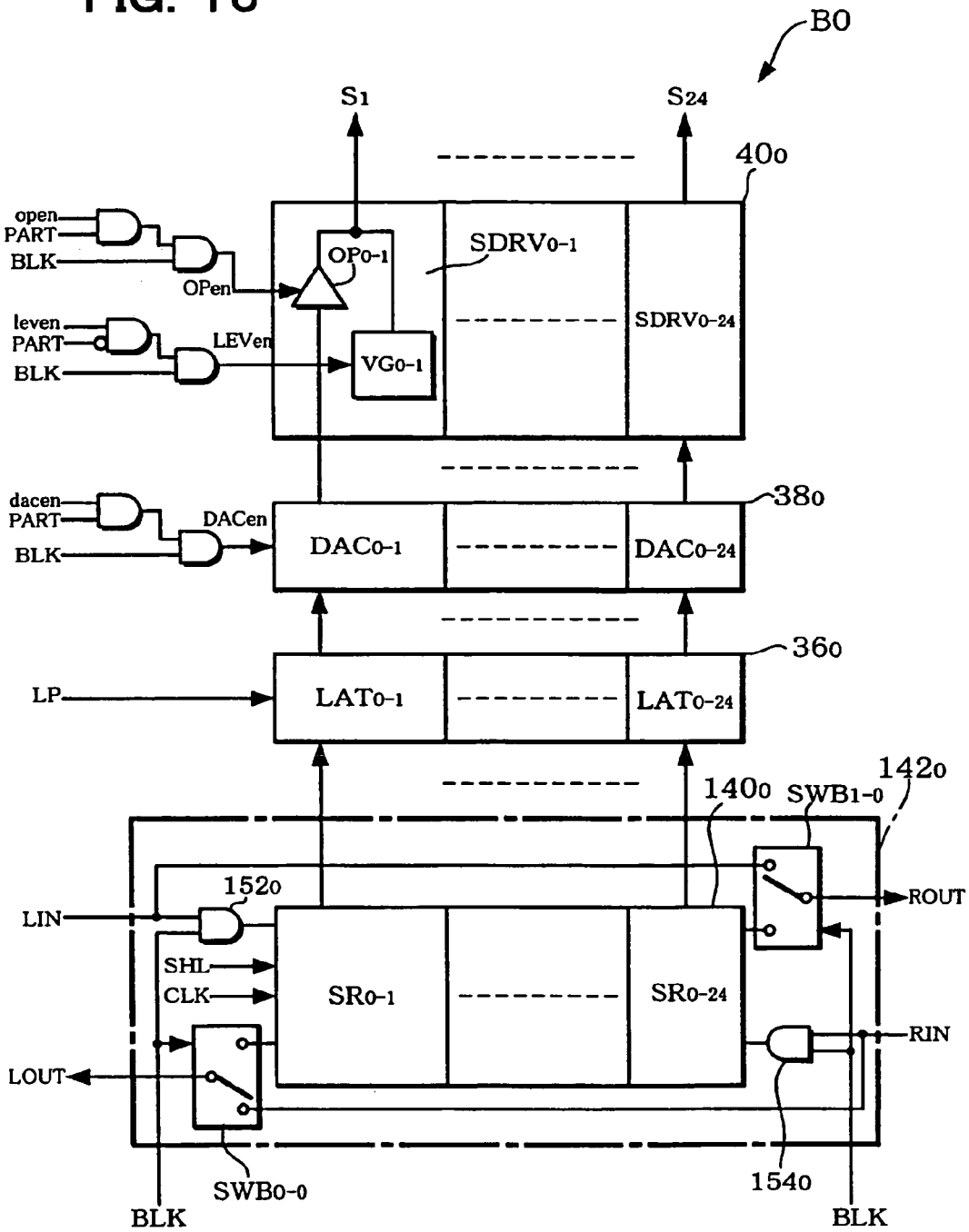
FIG. 16 is a diagram schematically showing the block controlled by the signal driver of the present embodiment.

FIG. 16 shows an outline of the configuration of the block unit controlled by the signal driver 30.

The signal driver 30 has 288 signal line outputs (S1–S288).

Specifically, the signal driver 30 has a configuration shown in FIG. 16 in a unit of 24 output terminals (S1 to S24, S25 to S48, . . . , S265 to S288), and has 12 blocks (B0 to B11) in total. The block B0 shown in FIG. 16 is described below as an example. However, the same content applies to the blocks B1 to B11.

The block B0 of the signal driver 30 includes a data bypass circuit 1420 including a shift register 1400, a line latch 360, a drive voltage generation circuit 380, and a signal line drive circuit 400 corresponding to the signal lines S1 to S24. The shift register 1400 has the function of the shift register 32 and the line latch 34 shown in FIG. 2.

The data bypass circuit 1420 includes the shift register 1400. The shift register 1400 includes SR0-1 to SR0-24 corresponding to each signal line. The line latch 360 includes LAT0-1 to LAT0-24 corresponding to each signal line. The drive voltage generation circuit 380 includes DAC0-1 to DAC0-24 corresponding to each signal line. The signal line drive circuit 400 includes SDRV0-1 to SDRV0-24 corresponding to each signal line.

3.2 Block Output Select Register

Figure 17:
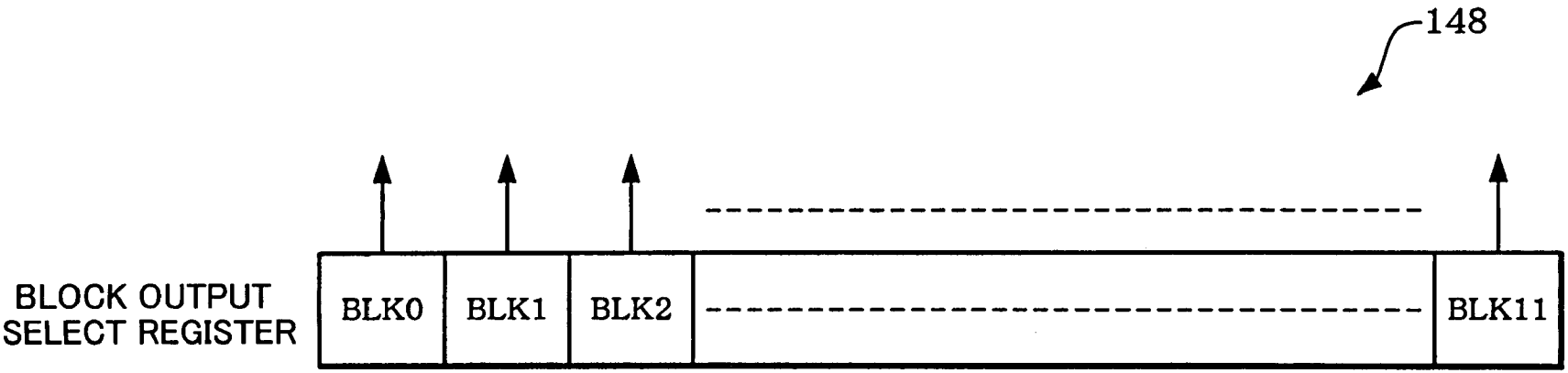
FIG. 17 is illustrative of a block output select register of the signal driver according to one embodiment of the present invention.

In the signal driver 30, the outputs of the signal line drive circuit are controlled in a high impedance state in units of blocks, as described above. Therefore, the signal driver 30 includes a block output select register 148 as shown in FIG. 17.

The block output select register 148 is set by the LCD controller 60. The LCD controller 60 updates the contents of the block output select register 148 of the signal driver 30 at a given timing controlled by the host (CPU), and configures an optimum signal drive circuit corresponding to the mounting conditions each time the contents are updated.

The block output select register 148 includes block output select data BLK0 to BLK11 which indicate whether or not to control the outputs of the signal line drive circuit in each block in a high impedance state corresponding to the blocks B0 to B11. In this embodiment, the signal lines of the LCD panel 20 are connected to the signal line drive circuit in the block in which the block output select data BLK0 to BLK11 is set to "1", whereby the signal is driven based on the image data. The signal lines of the LCD panel 20 are not connected to the signal line drive circuit in the block in which the block output select data BLK0 to BLK11 is set to "0", or the signal is not driven even if the signal lines are connected.

3.3 Partial Display Select Register

Figure 18:
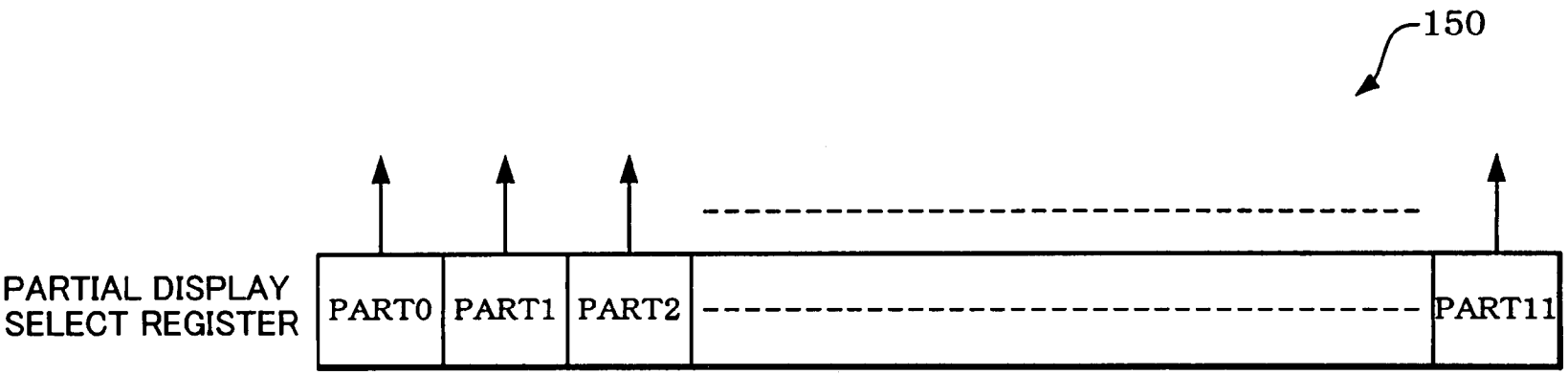
FIG. 18 is illustrative of a partial display select register of the signal driver of one embodiment of the present invention.

The signal driver 30 includes a partial display select register 150 as shown in FIG. 18. The partial display select register 150 is set by the LCD controller 60. The LCD controller 60 updates the contents of the partial display select register 150 of the signal driver 30 at a given timing controlled by the host (CPU), and achieves an optimum partial display each time the contents are updated.

The partial display select register 150 includes partial display data PART0 to PART11 which indicate whether or not to drive a signal through the signal lines in each block based on the image data corresponding to the blocks B0 to B11. In this embodiment, the display is controlled by using the block in which the partial display data PART0 to PART11 is set to "1," which indicates the output is ON as the display area, and the block in which the partial display data PART0 to PART11 is set to "0" which indicates the output is OFF as the non-display area.

As described above, the order of the partial display data must be changed in units of blocks in order to realize the partial display in units of blocks corresponding to the mounting conditions of the signal driver 30 without allowing the user to take into consideration the order of the blocks.

Therefore, in this embodiment, the order of the blocks in the block output select register and the partial display select register is changed corresponding to the shift direction by a block data rearrangement circuit described below.

Figure 19:
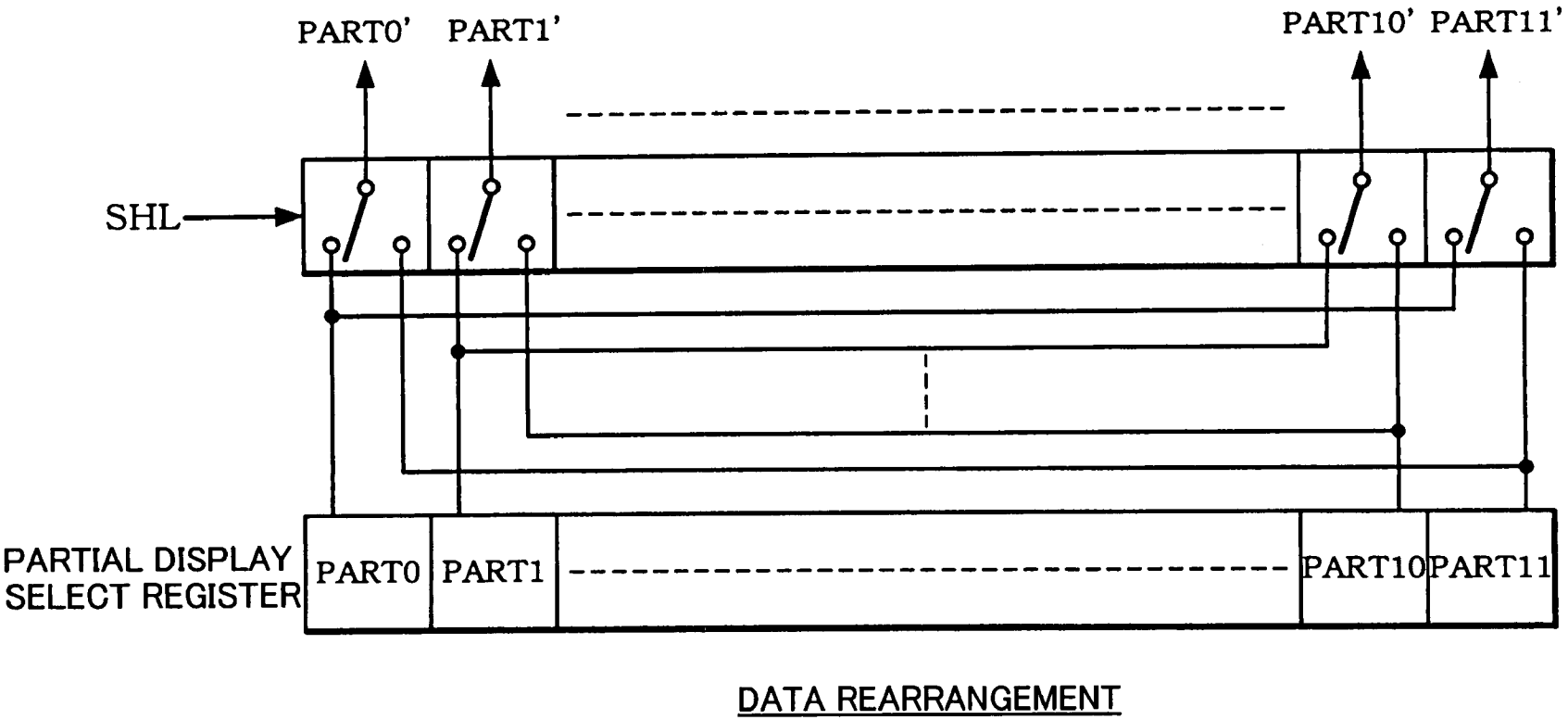
FIG. 19 shows an example of a block data rearrangement circuit according to one embodiment of the present invention.

FIG. 19 shows an example of the configuration of the block data rearrangement circuit.

This example shows a case where the partial display data is rearranged. The block data rearrangement circuit rearranges the order of the partial display data PART0 to PART11 set in the partial display data select register in response to the shift direction switch signal SHL. More specifically, the block data rearrangement circuit selectively outputs either the partial display data PART0 or PART11 as PART0' in response to the shift direction switch signal SHL. The block data rearrangement circuit selectively outputs either the partial display data PART1 or PART10 as PART1', either the partial display data PART2 or PART9 as PART2', . . . , and either the partial display data PART11 or PART0 as PART11' in response to the shift direction switch signal SHL.

The partial display data PART0' to PART 11' of which the order of the block units is changed corresponding to the shift direction is supplied to the corresponding blocks B0 to B11 as the data PART0, PART1, . . . , PART11 or PART11, PART10, . . . , PART0 corresponding to the shift direction. The partial display of each of the blocks B0 to B11 is controlled based on the partial display data PART0' to PART11'.

The partial display of the block B0 is controlled based on the partial display data PART0'.

In the block B0, the outputs of the drive circuit which drives each signal line are controlled into a high impedance state based on the block output select data BLK0'.

3.4 Data Bypass Circuit

The data bypass circuit 1420 in the block B0 includes AND circuits 1520 and 1540 which mask the image data input from the adjacent block with the block output select data BLK (BLK0'), as shown in FIG. 16.

The AND circuit 1520 masks a left direction data input signal LIN with the block output select data BLK (BLK0'). The AND circuit 1540 masks a right direction data input signal RIN with the block output select data BLK (BLK0'). The image data masked by the AND circuits 1520 and 1540 is supplied to the shift register 1400.

The data bypass circuit 1420 includes switching circuits SWB0-0 and SWB1-0.

The switching circuit SWB0-0 outputs the output data of the SR0-1 as a left direction data output signal LOUT when the block output select data BLK (BLK0') is "1" (logic level "H"). The switching circuit SWB0-0 outputs the image data shifted from the block B1 which is input as the right direction data input signal RIN as the left direction data output signal LOUT when the block output select data BLK (BLK0') is "0" (logic level "L").

The switching circuit SWB1-0 outputs the output data of the SR0–24 as a right direction data output signal ROUT when the block output select data BLK (BLK0') is "1" (logic level "H"). The switching circuit SWB0-0 outputs the image data which has been input as the left direction data input signal LIN (DIO in block B0) as the right direction data output signal ROUT when the block output select data BLK (BLK0') is "0" (logic level "L").

The shift register 1400 in the block B0 sequentially shifts the image data shifted from the shift register in the adjacent block in each SR in synchronization with the clock signal CLK. The shift register 1400 sequentially shifts the image data input from the shift register in the adjacent block as either the left direction data input signal LIN or the right direction data input signal RIN in response to the shift direction switch signal SHL. The input/output directions of the left direction data input signal LIN and left direction data output signal LOUT in the block B0 and the right direction data input signal RIN and right direction data output signal ROUT in the block B11 are switched by the shift direction switch signal SHL.

Figure 20A:
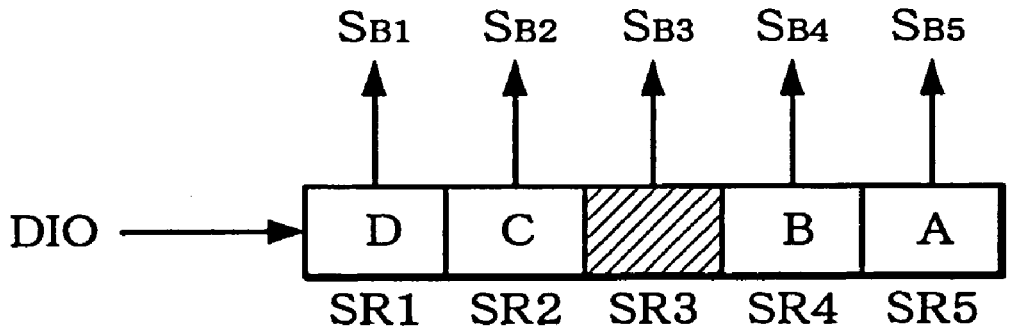
FIGS. 20A and 20B schematically show an example of operation of the data bypass circuit according to one embodiment of the present invention.
Figure 20B:
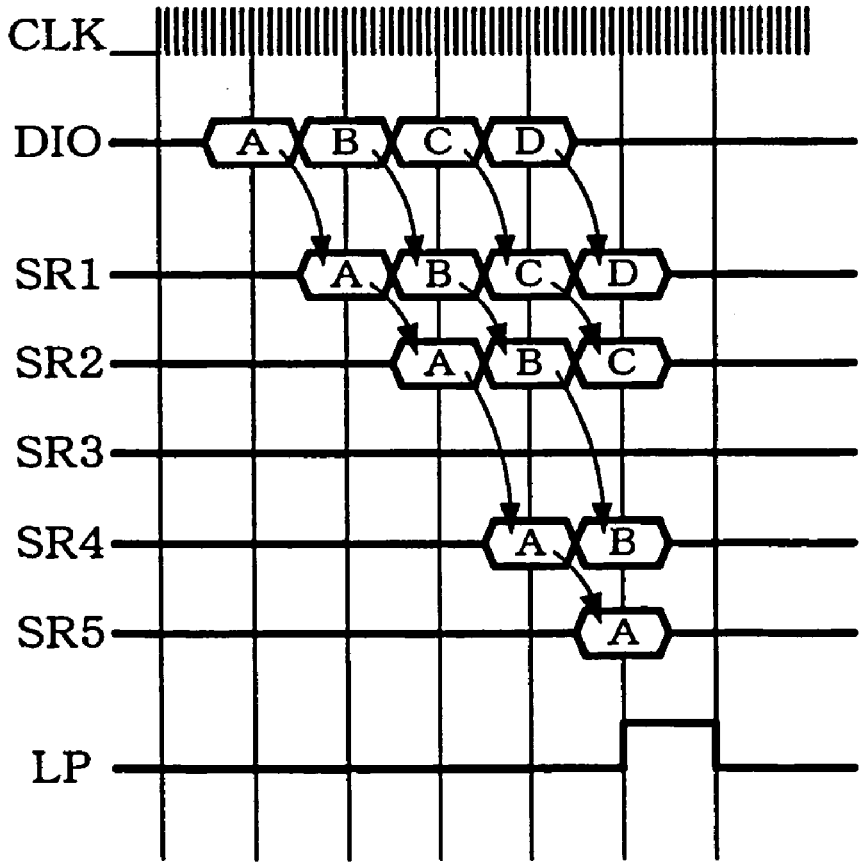

FIGS. 20A and 20B are views schematically showing an example of the operation of such a data bypass circuit.

This example illustrates a case where the image data (DIO) is sequentially shifted in the shift registers SR1 to SR5 provided corresponding to the blocks SB1 to SB5 from the shift register SR1, as shown in FIG. 20A. In this example, the block SB3 is set to a block output non-select state by the block output select data.

The image data (DIO) to be driven through the signal lines in the blocks SB5, SB4, SB2, and SB1 is sequentially shifted in synchronization with the clock signal CLK. In this case, since the shift register SR3 is bypassed in units of blocks, the image data sequentially shifted from the shift register SR1 is bypassed from the shift register SR2 to the shift register SR4.

As a result, image data A, B, C, and D is sequentially held in the shift registers SR5, SR4, SR2, and SR1 corresponding to the blocks SB5, SB4, SB2, and SB1. In the case where the image data for one horizontal scan is latched in the line latch by the horizontal synchronization signal LP in this state, the image data can be supplied to the signal driver without allowing the user to take into consideration the block set to the block output non-select state.

The operation of the data bypass circuit is not limited to the above example.

Figure 21A:
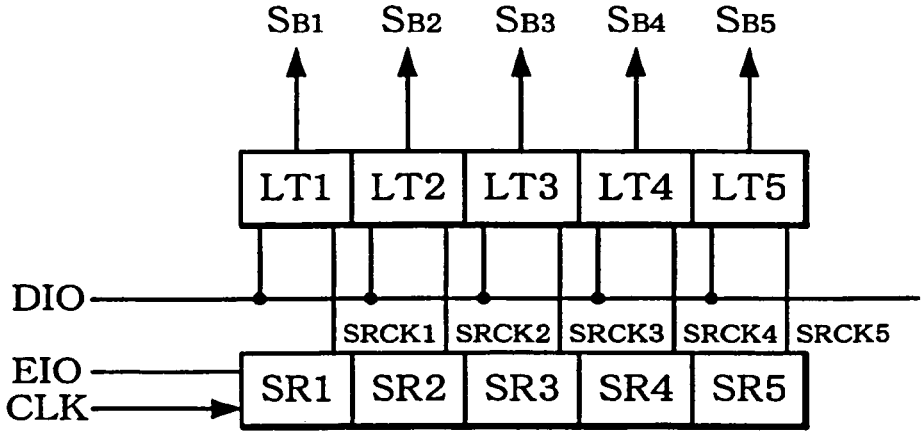
FIGS. 21A and 21B schematically show another example of operation of the data bypass circuit according to one embodiment of the present invention.
Figure 21B:
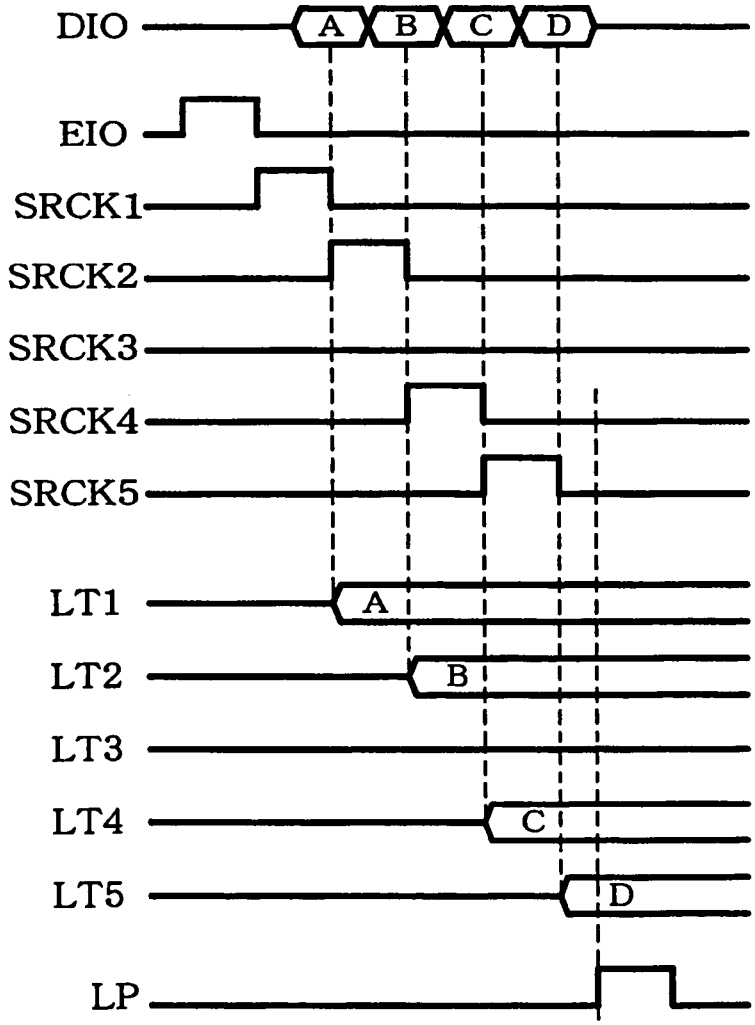

FIGS. 21A and 21B are views schematically showing another example of the operation of the data bypass circuit.

In this example, the data bypass circuit includes the shift registers SR1 to SR5 and latches LT1 to LT5 provided corresponding to the blocks SB1 to SB5, as shown in FIG. 21A. An enable input/output signal EIO is shifted in the shift registers SR1 to SR5 in synchronization with the clock signal CLK. The outputs of the shift registers are supplied to the latches LT1 to LT5 as shift register clock signals SRCK1 to SRCK5.

The image data (DIO) is input in synchronization with the shift register clock signal SRCK.

In this example, the block SB3 is set to the block output non-select state by the block output select data.

Since the enable input/output signal EIO shifted in synchronization with the clock signal CLK is bypassed by the shift register SR3 in units of blocks, the enable input/output signal EIO sequentially shifted from the shift register SR1 is bypassed from the shift register SR2 to the shift register SR4.

Therefore, the image data A, B, C, and D is respectively latched in the latches LT1, LT2, LT4, and LT5 by supplying the image data (DIO) in response to the shift register clock signals SRCK1, SRCK2, SRCK4, and SRCK5.

In the case where the image data for one horizontal scan is latched in the line latch by the horizontal synchronization signal LP in this state, the image data can be supplied to the signal driver without allowing the user to take into consideration the block set to the block output non-select state.

The shift register 1400 which sequentially shifts the image data is described below.

Figure 22:
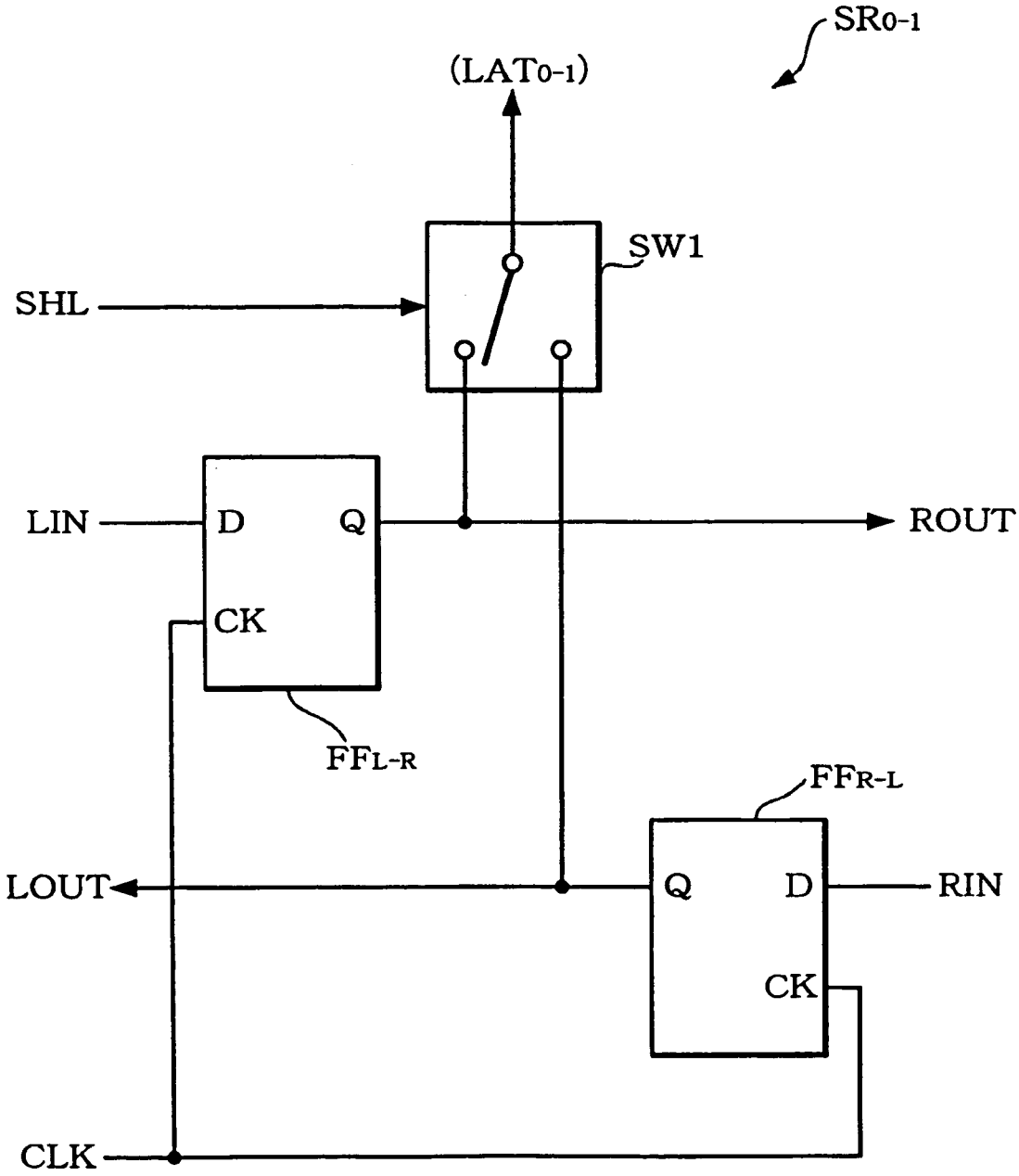
FIG. 22 is a diagram showing the configuration of an SR which makes up a shift register according to one embodiment of the present invention.

FIG. 22 schematically shows a configuration of the SR0-1 which makes up the shift register 1400.

Although the configuration of the SR0-1 is illustrated below, the same configuration also applies to the SR0-2 to SR0-24.

The SR0-1 includes an FFL-R, FFR-L, and SW1.

The FFL-R latches the left direction data input signal LIN input to a D terminal in synchronization with the leading edge of the clock signal input to a CK terminal. The FFL-R supplies the left direction data input signal LIN to the D terminal of the SR0-2 from a Q terminal as the right direction data output signal ROUT, for example.

The FFR-L latches the right direction data input signal RIN input to the D terminal in synchronization with the leading edge of the clock signal input to the CK terminal, and outputs the left direction data output signal LOUT from the Q terminal, for example.

The right direction data output signal ROUT output from the Q terminal of the FFL-R and the left direction output signal LOUT output from the Q terminal of the FFR-L are also supplied to the SW1. The SW1 selects either the right direction data output signal ROUT or left direction output signal LOUT corresponding to the shift direction switch signal SHL, and supplies the signal to the LAT0-1 of the line latch 360.

The image data held by the SR0-1 to SR0-24 of the shift register 1400 is latched in the LAT0-1 to LAT0-24 of the line latch 360 in synchronization with the horizontal synchronization signal LP.

3.5 Line Latch

The image data corresponding to the signal line S1 latched in the line latch LAT0-1 is supplied to the DAC0-1 of the drive voltage generation circuit. The DAC0-1 generates 64 levels of gray scale voltages when a DAC enable signal DACen is at a logic level of "H", based on 6-bit gradation data supplied from the LAT0-1, for example.

3.6 Drive Voltage Generation Circuit

Figure 23:
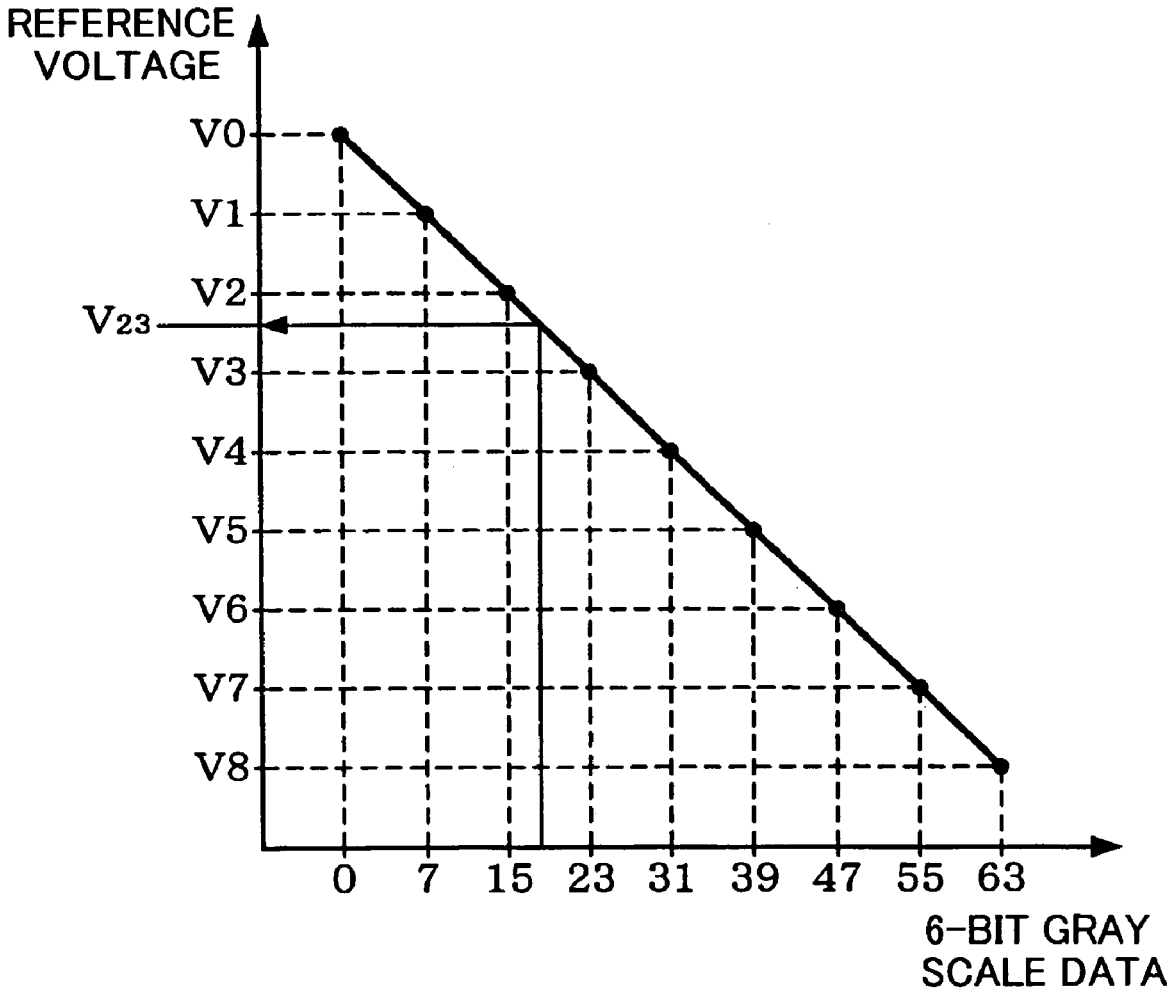
FIG. 23 is illustrative of gray scale voltages generated by the DAC according to one embodiment of the present invention.

FIG. 23 is a view for describing the gray scale voltage generated by the DAC0-1.

The reference voltages at levels of V0 to V8 are supplied to the DAC0-1 from the power supply circuit 80, for example. When the DAC enable signal DACen becomes a logic level of "H", the DAC0-1 selects one of the voltage ranges divided by V0 to V8 from 3 higher order bits among the 6-bit gradation data as the image data of each signal line, for example. When the voltage range between the reference voltages V2 and V3 is selected, the DAC0-1 selects V23 which is one of the eight levels between V2 and V3 specified by the 3 lower order bits among the 6-bit gradation data, for example.

The drive voltage selected by the DAC0-1 corresponding to the signal line S1 is supplied to an SDRV0-1 of the signal line drive circuit 400. The drive voltage is also supplied to the signal lines S2 to S24.

In this embodiment, the DAC enable signal DACen is generated by the logical product of an enable signal dacen0 and the block output select data BLK (BLK0') in the block output select register which indicates whether or not to put the signal lines in the block B0 in a high impedance state. The enable signal dacen0 is generated by the logical product of a DAC control signal dacen generated by a control circuit (not shown) of the signal driver 30 and the partial display data PART (PART0') which indicates whether or not to allow the partial display in the block B0 in the partial display select register.

Specifically, when the block output select data BLK (BLK0') is "0", the DAC enable signal DACen causes the operation of the drive voltage generation circuit 380 in the BLK0 to be terminated irrespective of the setting of the partial display data PART (PART0'). When the block output select data BLK (BLK0') is "1", the DAC operation is performed when the block B0 is set to be the partial display area. When the block B0 is set to be the partial non-display area, the DAC operation is terminated, thereby reducing consumption of current flowing through a ladder resistance.

The DAC enable signal DACen is also supplied to the DAC0-2 to DAC0-24 corresponding to the signal lines S2 to S24, whereby the DAC operation is controlled in units of blocks.

3.7 Signal Drive Circuit

The SDRV0-1 of the signal line drive circuit 400 includes a voltage-follower-connected operational amplifier OP0-1 as an impedance conversion circuit, and a partial-non-display-level voltage supply circuit VG0-1.

3.7.1 Operational Amplifier

The output terminal of the voltage-follower-connected operational amplifier OP0-1 is negative feedbacked. Therefore, the input impedance of the operational amplifier is extremely increased, whereby the input current barely flows. When an operational amplifier enable signal OPen is at a logic level of "H", the operational amplifier converts the impedance of the drive voltage generated by the DAC0-1, and drives the signal line S1. This enables the signal to be driven irrespective of the output load of the signal line S1.

In this embodiment, the operational amplifier enable signal OPen is generated by the logical product of an enable signal open0 and the block output select data BLK (BLK0') in the block output select register which indicates whether or not to put the signal lines in the block B0 in a high impedance state. The enable signal open0 is generated by the logical product of an operational amplifier control signal open generated by a control circuit (not shown) of the signal driver 30 and the partial display data PART (PART0') in the partial display select register which indicates whether or not to allow the partial display in the block B0.

Specifically, when the block output select data BLK (BLK0') is "0", the operational amplifier enable signal OPen terminates the operation of the operational amplifier in the BLK0 (current consumption is reduced by terminating the current source of the operational amplifier) irrespective of the setting of the partial display data PART (PART0'). When the block output select data BLK (BLK0') is "1", the operational amplifier converts the impedance of the drive voltage generated by the drive voltage generation circuit, and drives the corresponding signal lines when the block B0 is set to be the partial display area. When the block B0 is set to be the partial non-display area, the operation of the operational amplifier is terminated, thereby reducing current consumption.

Figure 24:
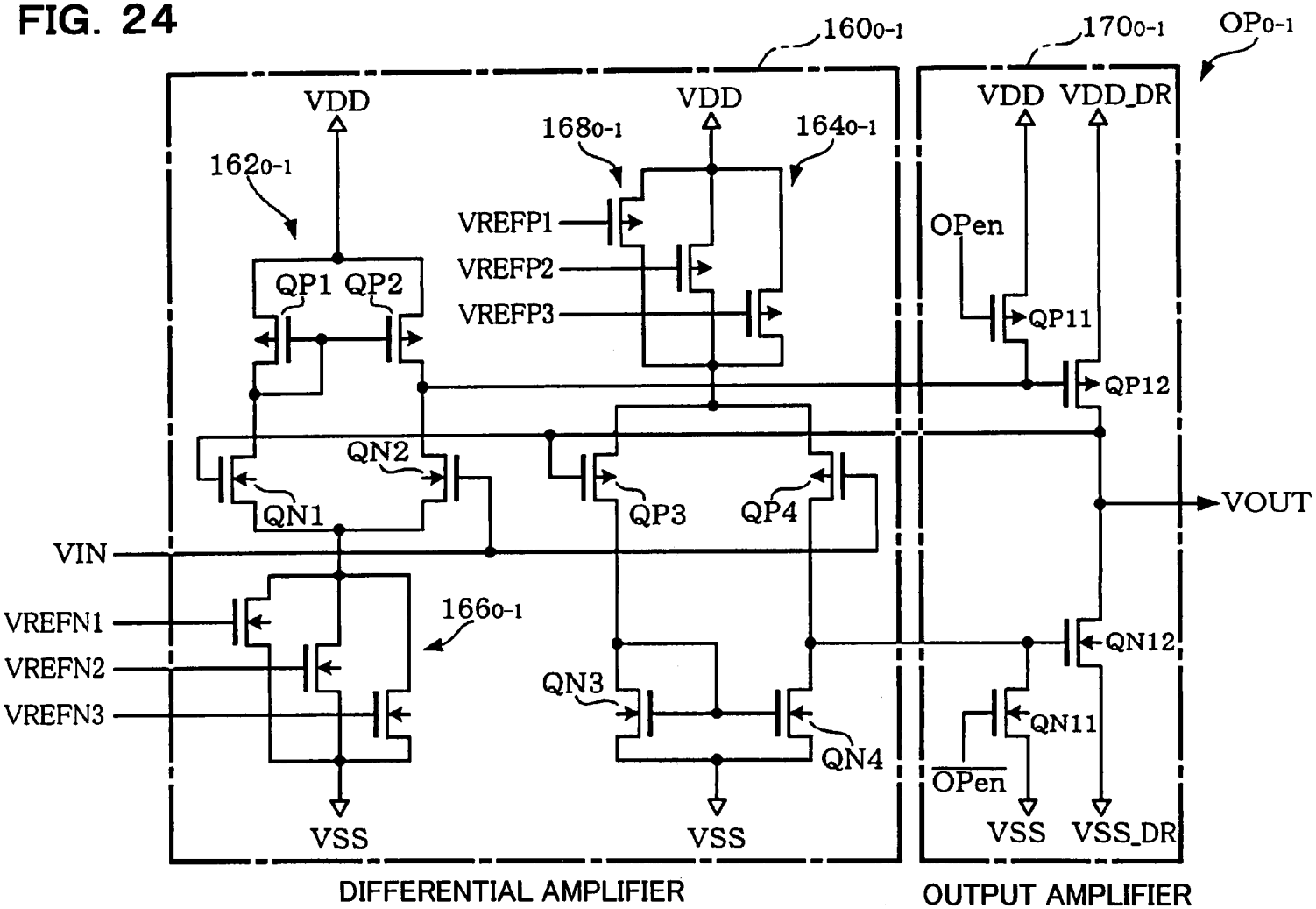
FIG. 24 is a circuit diagram showing the configuration of a voltage-follower-connected operational amplifier OP according to one embodiment of the present invention.

FIG. 24 shows an example of the configuration of the voltage-follower-connected operational amplifier OP0-1.

The operational amplifier OP0-1 includes a differential amplifier section 1600-1 and an output amplifier section 1700-1. The operational amplifier OP0-1 converts the impedance of an input voltage VIN supplied from the DAC0-1 according to the operational amplifier enable signal OPen, and outputs an output voltage VOUT.

The differential amplifier section 1600-1 includes first and second differential amplifier circuits 1620-1 and 1640-1.

The first differential amplifier circuit 1620-1 includes at least p-type transistors QP1 and QP2 and n-type transistors ON1 and QN2.

In the first differential amplifier circuit 1620-1, source terminals of the p-type transistors QP1 and QP2 are connected to a power supply voltage level VDD. Gate terminals of the p-type transistors QP1 and QP2 are interconnected. These gate terminals are connected to a drain terminal of the p-type transistor QP1 to form a current mirror structure. The drain terminal of the p-type transistor QP1 is connected to a drain terminal of the n-type transistor ON1. A drain terminal of the p-type transistor QP2 is connected to a drain terminal of the n-type transistor QN2.

The output voltage VOUT is supplied and negative feedbacked to the gate terminal of the n-type transistor QN1. The input voltage VIN is supplied to the gate terminal of the n-type transistor QN2.

Source terminals of the n-type transistors QN1 and QN2 are connected to a ground level VSS through a current source 1660-1 formed when one of the reference voltage select signals VREFN1 to VREFN3 is set at a logic level of "H".

The second differential amplifier circuit 1640-1 includes at least p-type transistors QP3 and QP4 and n-type transistors QN3 and QN4.

In the second differential amplifier circuit 1640-1, source terminals of the n-type transistors QN3 and QN4 are connected to the ground level VSS. Gate terminals of the n-type transistors QN3 and QN4 are interconnected. These gate terminals are connected to a drain terminal of the n-type transistor QN3 to form a current mirror structure. The drain terminal of the n-type transistor QN3 is connected to a drain terminal of the p-type transistor QP3. The drain terminal of the n-type transistor QN4 is connected to a drain terminal of the p-type transistor QP4.

The output voltage VOUT is supplied and negative feedbacked to the gate terminal of the p-type transistor QP3. The input voltage VIN is supplied to the gate terminal of the p-type transistor QP4.

Source terminals of the p-type transistors QP3 and QP4 are connected to the power supply voltage level VDD through a current source 1680-1 formed when one of the reference voltage select signals VREFP1 to VREFP3 is at a logic level of "L".

The output amplifier section 1700-1 includes p-type transistors QP11 and QP12 and n-type transistors QN11 and QN12.

In the output amplifier section 1700-1, a source terminal of the p-type transistor QP11 is connected to the power supply voltage level VDD. The operational amplifier enable signal OPen is supplied to a gate terminal of the p-type transistor QP11. A drain terminal of the p-type transistor QP11 is connected to a drain terminal of the p-type transistor QP2 and a gate terminal of the p-type transistor QP12.

A source terminal of the p-type transistor QP12 is connected to a drive voltage level VDD_DRV. The output voltage VOUT is output from a drain terminal of the p-type transistor QP12.

A source terminal of the n-type transistor QN11 is connected to the ground level VSS. An inversion signal of the operational amplifier enable signal OPen is supplied to a gate terminal of the n-type transistor QN11. A drain terminal of the n-type transistor QN11 is connected to the drain terminal of the n-type transistor QN4 and a gate terminal of the n-type transistor QN12.

A source terminal of the n-type transistor QN12 is connected to a drive ground level VSS_DRV. The output voltage VOUT is output from a drain terminal of the n-type transistor QN12.

Figure 25:
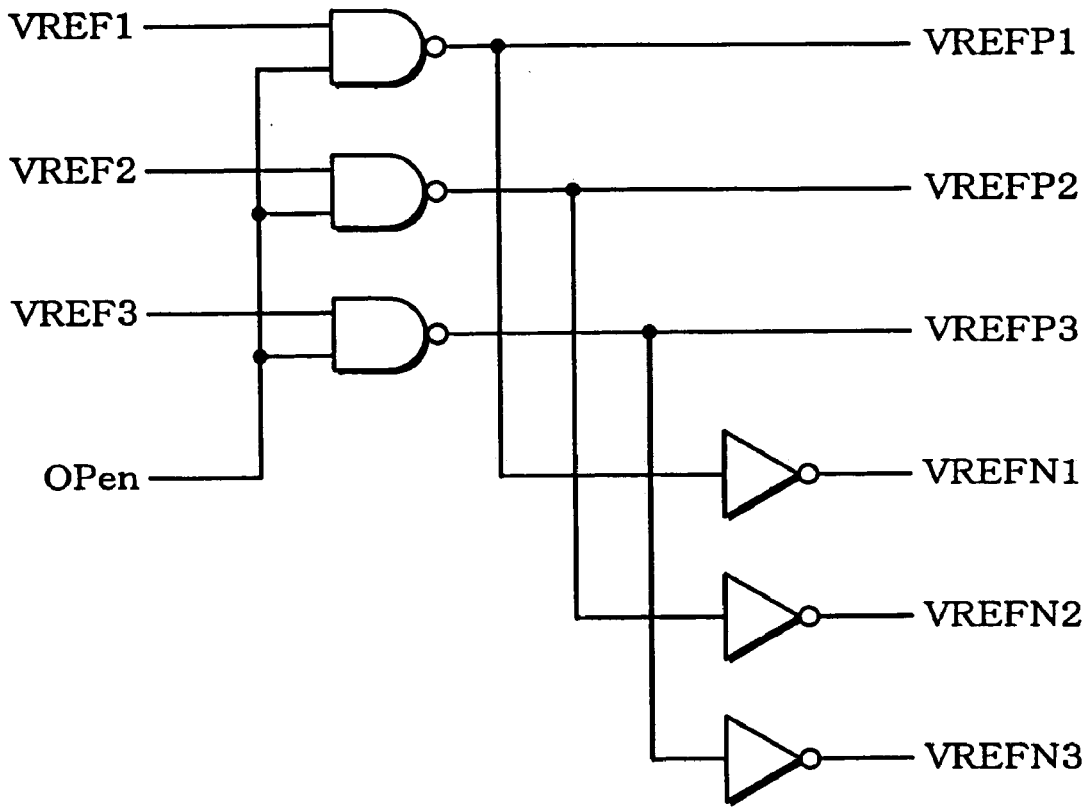
FIG. 25 is a circuit diagram showing the configuration of a reference voltage select signal generation circuit of the present embodiment.

FIG. 25 shows an outline of the configuration of a reference voltage select signal generation circuit which supplies the reference voltage select signal to the first and second differential amplifier circuits 1620-1 and 1640-1.

In this embodiment, a current source having an optimum current drive capability corresponding to the output load can be formed by the reference voltage select signals VREF1 to VREF3. Therefore, the reference voltage select signal generation circuit generates reference voltage select signals VREFP1 to VREFP3 for the p-type transistors and reference voltage select signals VREFN1 to VREFN3 for the n-type transistors by the reference voltage select signals VREF1 to VREF3.

The reference voltage select signal generation circuit controls the current sources 1660-1 and 1680-1 only when the logic level of the operational amplifier enable signal OPen is "H" by the reference voltage select signals VREFP1 to VREFP3 for the p-type transistors and the reference voltage select signals VREFN1 to VREFN3 for the n-type transistors corresponding to the state of the reference voltage select signals VREF1 to VREF3. When the logic level of the operational amplifier enable signal OPen is "L", the reference voltage select signal generation circuit masks the reference voltage select signals VREF1 to VREF3. This eliminates current flowing through the current sources 1660-1 and 1680-1, whereby the differential amplification operation is terminated.

An outline of the operation of the voltage-follower-connected operational amplifier OP0-1 having the above configuration is described below.

When the logic level of the operational amplifier enable signal OPen is "H", if the output voltage VOUT is lower than the input voltage VIN, the potential of the drain terminal of the n-type transistor QN2 is decreased in the first differential amplifier circuit 1620-1, whereby the potential of the output voltage VOUT is increased through the p-type transistor QP12.

When the output voltage VOUT is higher than the input voltage VIN, the potential of the drain terminal of the p-type transistor QP4 is decreased in the second differential amplifier circuit 1640-1, whereby the potential of the output voltage VOUT is increased through the n-type transistor QN12.

When the logic level of the operational amplifier enable signal OPen is "L", since the reference voltage select signals VREF1 to VREF3 are masked as shown in FIG. 25, each of the transistors of the current sources 1660-1 and 1680-1 is turned OFF. The drain terminal of the p-type transistor QP11 is connected to the power supply voltage level VDD, and the drain terminal of the n-type transistor QN11 is connected to the ground level VSS. Therefore, the output voltage VOUT is in a high impedance state. In this case, a partial-non-display-level voltage generated by a partial-non-display-level voltage supply circuit VG0-1 described later is supplied to the signal lines to which the output voltage VOUT should be supplied.

3.7.2 Partial-Non-Display-Level Voltage Supply Circuit

When a non-display-level voltage supply enable signal LEVen is at a logic level of "H", the partial-non-display-level voltage supply circuit VG0-1 generates a given non-display-level voltage VPART-LEVEL to be supplied to the signal lines when set to the non-display area (output is OFF) in the partial display select register.

The non-display-level voltage VPART-LEVEL, the threshold value VCL at which the transmittance of the pixel is changed, and the common electrode voltage Vcom of the common electrode opposite to the pixel electrode have a relation shown by the following formula (1).

$$|V\text{PART-LEVEL}-Vcom|<VCL \quad (1)$$

Specifically, the non-display-level voltage VPART-LEVEL has a voltage level at which the voltage applied to the liquid crystal capacitance does not exceed the threshold value VCL when the non-display-level voltage VPART-LEVEL is applied to the pixel electrode connected to the drain electrode of the TFT connected to the signal line to be driven.

It is preferable that the non-display-level voltage VPART-LEVEL have the same voltage level as the common electrode voltage Vcom from the viewpoint of ease of generation and control of the voltage level. Therefore, the same voltage level as the common electrode voltage Vcom is supplied. In this case, a color when the liquid crystal is in the OFF state is displayed in the non-display area of the LCD panel 20.

The non-display-level voltage supply circuit VG0-1 selectively outputs either the voltage level V0 or V8 on the opposite edges of the gradation level voltages as the non-display-level voltage VPART-LEVEL. The voltage level V0 or V8 on the opposite edges of the gradation level voltages is a voltage level for alternately outputting data for each frame using the inversion drive method. In this embodiment, the common electrode voltage Vcom or the voltage level V0 or V8 on the opposite edges of the gradation level voltages can be selected as the non-display-level voltage VPART-LEVEL by the select signal SEL designated by the user. This enables the user to increase the degree of freedom relating to the color in the non-display area.

In this embodiment, the non-display-level voltage supply enable signal LEVen is generated by the logical product of a non-display-level voltage supply circuit control signal leven generated by a control circuit (not shown) of the signal driver 30 and an inversion signal of the partial display data PART (PART0') in the partial display select register which indicates whether or not to allow the partial display in the block B0. Specifically, a given non-display-level voltage is driven through the signal lines only when the block B0 is set to be the non-display area (output is OFF). When the block B0 is set to be the display area (output is ON), the output of the non-display-level voltage supply circuit VG0-1 is in a high impedance state, whereby the signal lines are not driven.

The operational amplifier enable signal OPen and the non-display-level voltage supply enable signal LEVen are also supplied to the SDRV0-2 to SDRV0-24 corresponding to the signal lines S2 to S24, whereby the drive control of the signal lines is performed in units of blocks.

Figure 26:
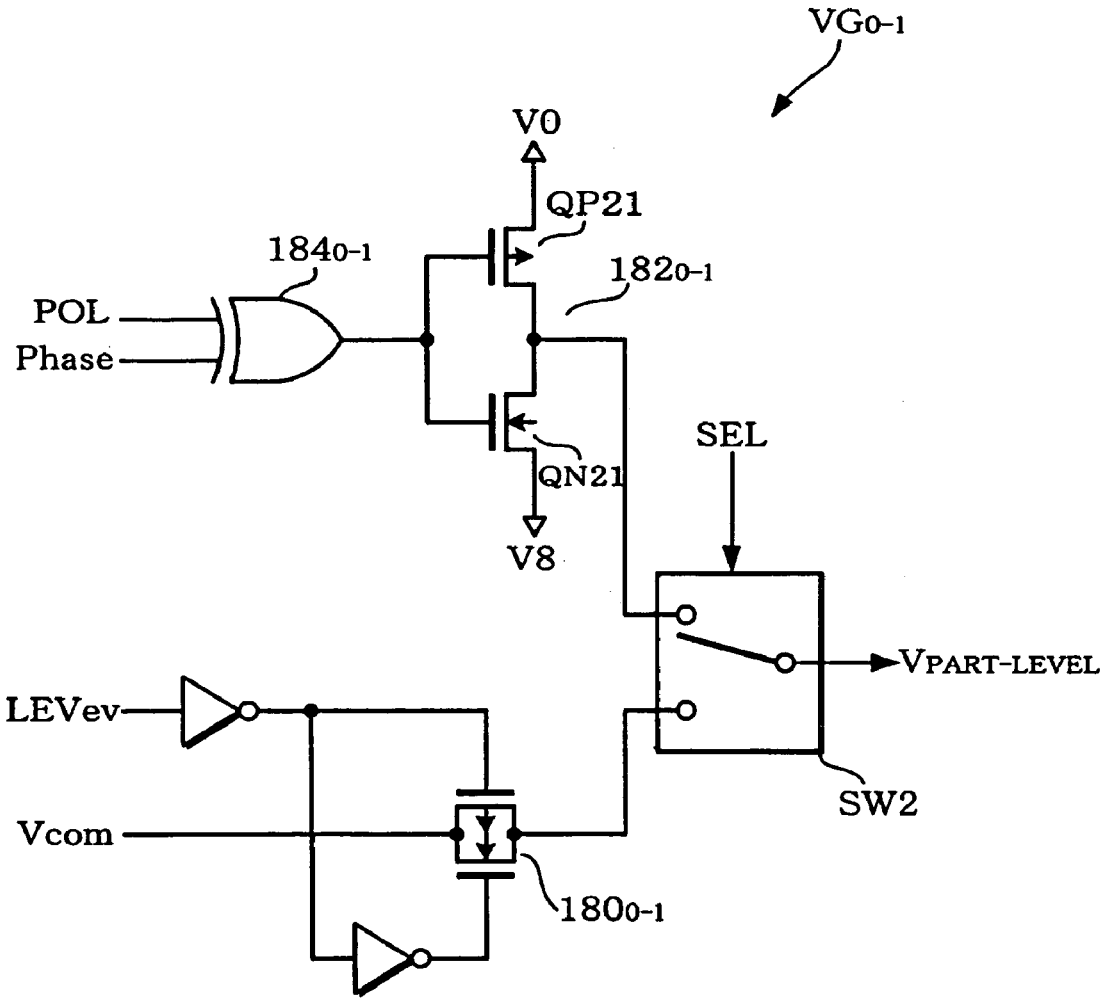
FIG. 26 is a circuit diagram showing the configuration of a non-display-level voltage supply circuit according to one embodiment of the present invention.

FIG. 26 shows an example of a configuration of the non-display-level voltage supply circuit VG0-1.

The non-display-level voltage supply circuit VG0-1 includes a transfer circuit 1800-1 for outputting the voltage Vcom equal to the common electrode voltage by the non-display-level voltage supply enable signal LEVen, an inverter circuit 1820-1, and a switching circuit SW2.

The inverter circuit 1820-1 includes an n-type transistor QN21 and a p-type transistor QP21 of which the drain terminals are interconnected. The voltage level V8 is connected to a source terminal of the n-type transistor QN21. The voltage level V0 is connected to a source terminal of the p-type transistor QP21. The gate terminal of the n-type transistor QN21 and the gate terminal of the p-type transistor QP21 are connected to an XOR circuit 1840-1. The XOR circuit 1840-1 calculates the exclusive OR of a polarization inversion signal POL which indicates the timing of the polarization inversion and a Phase which indicates the present phase.

In the inverter circuit 1820-1, the logic level of the Phase which indicates the present phase is reversed according to the timing of the polarization inversion signal POL, and either the voltage level V0 or V8 is supplied to the switching circuit SW2.

The switching circuit SW2 outputs one of the output of the transfer circuit 1800-1, the output of the inverter circuit 1820-1, and the high impedance state by the select signal SEL as the non-display-level voltage VPART-LEVEL.

3.8 Operation

FIG. 27 shows the control contents of each section of the signal driver 30.

In the signal driver 30, whether or not to perform the block output and whether or not to perform the partial display can be selected in units of blocks in the block output select register 148 and the partial display select register 150, as shown in FIGS. 17 and 18.

In the case where the block output non-select (BLK=0) is set in the block output select register 148, the image data is bypassed in the shift register irrespective of the setting of the partial display data in the block. At the same time, the operations of the drive voltage generation circuit and the signal line drive circuit provided corresponding to the signal lines in the block are terminated.

In the case where the block output select (BLK=1) is set in the block output select register 148, the image data bypass function is turned OFF in the shift register irrespective of the setting of the partial display data in the block.

In this case, when the partial display select (PART=1) is set, the drive voltage generation circuit and the operational amplifier are operated, and the operation of the non-display-level voltage supply circuit is terminated.

When the partial display non-select (PART=0) is set, the operations of the drive voltage generation circuit and the operational amplifier are terminated, and the non-display-level voltage generated by the non-display-level voltage supply circuit is supplied to the signal lines in the block.

Figure 28:
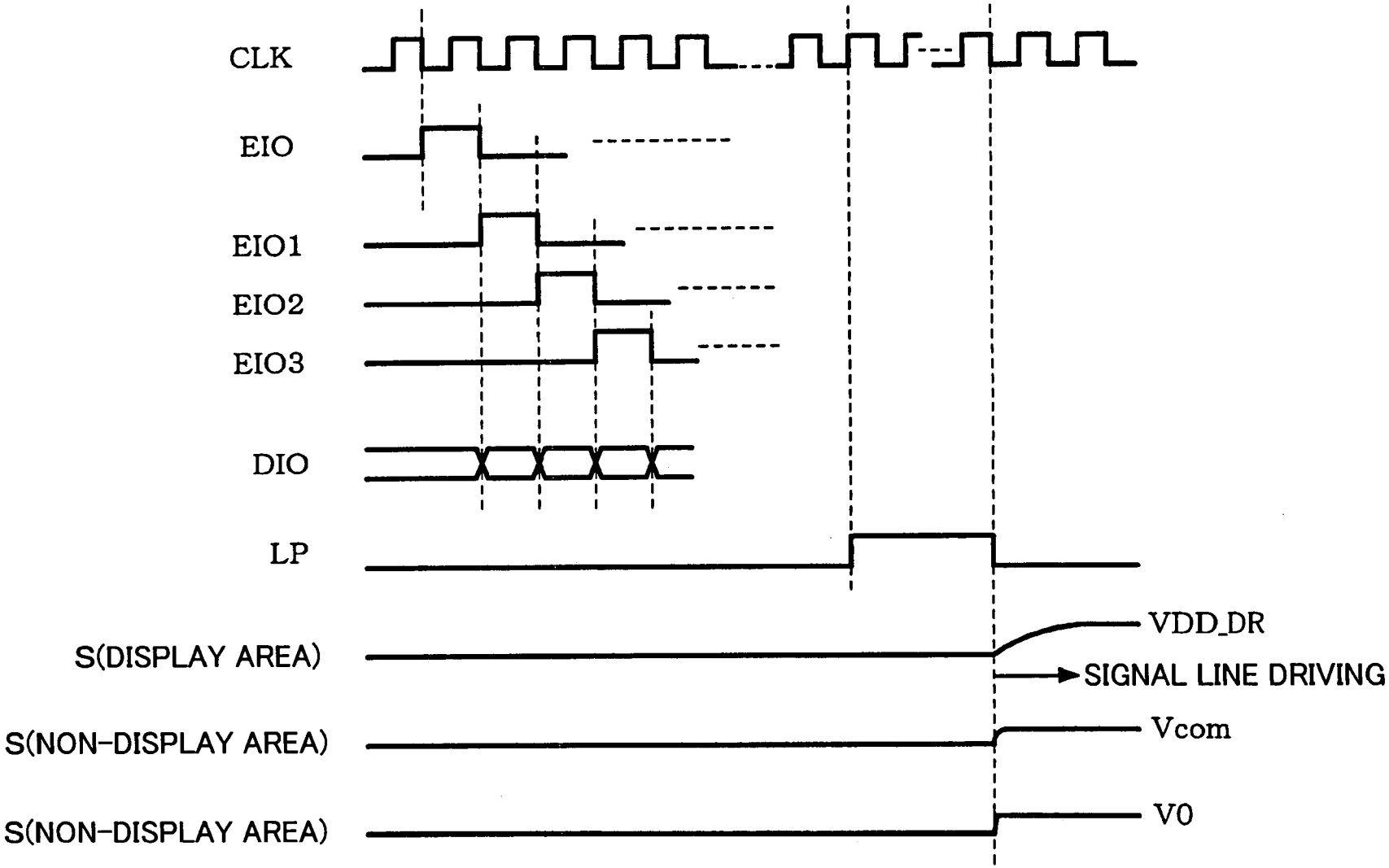
FIG. 28 is a timing chart showing waveforms of the signal driver according to one embodiment of the present invention.

FIG. 28 shows an example of the operation of the signal driver 30.

The shift register shifts the enable input/output signal EIO in synchronization with the clock signal CLK, and generates EIO1 to EIOL (L is a natural number of two or more). The image data (DIO) is sequentially latched in the line latch in synchronization with the EIO1 to EIOL.

The line latch 36 latches the image data for one horizontal scan in synchronization with the leading edge of the horizontal synchronization signal LP, and drives the signal lines by the DAC 38 and the signal line drive circuit 40 from the falling edge of the horizontal synchronization signal LP.

In this embodiment, it is possible to select whether or not to drive the signal lines based on the image data in units of blocks as described above. This enables the setting of the display area and the non-display area. The signal lines in the block set to the display area are driven based on the drive voltage generated based on the gradation data. The common electrode voltage Vcom or one of the voltages on opposite edges of the gray scale voltage levels is selectively output to the signal lines in the block set to the non-display area.

The signal lines in the block in which the block output non-select is selected are controlled into a high impedance state (not shown).

A signal drive circuit, which can flexibly deal with the change of the size of the liquid crystal panel and can decrease the power consumption, can be provided by using the signal driver of this embodiment. Moreover, since a change of design is unnecessary, products can be provided without delaying placement on the market.

The present invention is not limited to the above-described embodiments, and various modifications can be made within the scope of the invention. For example, the present invention can be applied not only to the drive of the LCD panel, but also to electroluminescence and plasma display devices.

The embodiment of the present invention illustrate an example in which the 24 adjacent outputs are divided as one block. However, the present invention is not limited thereto. One block may consist of less than or more than 24 outputs. Moreover, it is unnecessary to divide the continuous signal lines. A plurality of signal lines selected at a given interval may make up one block.

Furthermore, the signal driver of the embodiment of the present invention can be applied not only to the line inversion drive method, but also to the frame inversion drive method.

In the embodiment of the present invention, the display device includes the LCD panel, scanning driver, and signal driver. However, the present invention is not limited thereto. For example, the LCD panel may include the scanning driver and signal driver.

Although the embodiment of the present invention is described taking the active matrix type liquid crystal panel using a TFT liquid crystal as an example, the present invention is not limited thereto.

What is claimed is:

1. A signal drive circuit which drives signal lines of an electro-optical device having pixels specified by a plurality of scan lines and a plurality of signal lines which intersect each other, based on image data, the signal drive circuit comprising:

a line latch which latches the image data in a horizontal scanning cycle;

a drive voltage generation circuit which generates a drive voltage for each signal line based on the image data latched in the line latch; and a signal line drive circuit which drives each signal line based on the drive voltage generated by the drive voltage generation circuit;

a shift register which temporarily holds image data necessary for one horizontal scan to be latched by the line latch, and includes flip-flops connected to each other and corresponding to the signal lines, the image data being input sequentially in a unit of a given bits; and a data transfer circuit provided in each block to receive and transfer image data to flip-flops in an adjacent block when high impedance control is performed on a block in which the data transfer circuit is provided, each block being provided in units of the given plural number of the signal lines, wherein the signal line drive circuit determines whether to perform high impedance control for an output of the signal line drive circuit in units of a given plural number of the signal lines, and wherein the data transfer circuit does not transfer the image data to flip-flops in an adjacent block when high impedance control is not performed on a block in which the data transfer circuit is provided.

2. The signal drive circuit as defined in claim 1, wherein operation termination of the drive voltage generation circuit is controlled in units of the given plural number of the signal lines.

3. The signal drive circuit as defined in claim 1, further comprising:

a control instruction data holding circuit which holds control instruction data in units of the given plural number of the signal lines, wherein the control instruction data is used to perform high impedance control for an output of the signal line drive circuit, or to control operation termination of the drive voltage generation circuit, in units of the given plural number of the signal lines.

4. The signal drive circuit as defined in claim 1, wherein an output of the drive voltage for the signal lines is controlled in units of the given plural number of the signal lines, in one or more blocks in which no high impedance control is performed for the output of the signal line drive circuit, each block begin provided in units of the given plural number of the signal lines.

5. The signal drive circuit as defined in claim 1, wherein each of the blocks correspond to 8 pixels.

6. A display device comprising:

an electro-optical device having pixels specified by a plurality of scan lines and a plurality of signal lines which intersect each other;

a scanning drive circuit which drives the scan lines; and the signal drive circuit as defined in claim 1 which drives the signal lines based on image data.

7. An electro-optical device comprising:

pixels specified by a plurality of scan lines and a plurality of signal lines which intersect each other;

a scanning drive circuit which drives the scan lines; and the signal drive circuit as defined in claim 1 which drives the signal lines based on image data.

* * * * *